US007255752B2

(12) United States Patent
Ishizaka et al.

(10) Patent No.: US 7,255,752 B2
(45) Date of Patent: Aug. 14, 2007

(54) METHOD FOR MANUFACTURING R-T-B SYSTEM RARE EARTH PERMANENT MAGNET

(75) Inventors: Chikara Ishizaka, Tokyo (JP); Gouichi Nishizawa, Tokyo (JP); Tetsuya Hidaka, Tokyo (JP); Akira Fukuno, Tokyo (JP); Nobuya Uchida, Tokyo (JP)

(73) Assignee: TDK Corporation, Tokyo (JP)

( * ) Notice: Subject to any disclaimer, the term of this patent is extended or adjusted under 35 U.S.C. 154(b) by 249 days.

(21) Appl. No.: 10/799,243

(22) Filed: Mar. 11, 2004

(65) Prior Publication Data

US 2004/0187962 A1 Sep. 30, 2004

(30) Foreign Application Priority Data

Mar. 28, 2003 (JP) ..... 2003-092890

(51) Int. Cl.
*H01F 1/057* (2006.01)

(52) U.S. Cl. ..... 148/101; 148/103; 419/12

(58) Field of Classification Search ..... None
See application file for complete search history.

(56) References Cited

U.S. PATENT DOCUMENTS 4,836,868 A 6/1989 Yajima et al.
4,895,607 A 1/1990 Yang et al.
5,014,575 A 5/1991 Fujiwara et al.
5,595,608 A 1/1997 Takebuchi et al.
5,858,123 A 1/1999 Uchida et al.
6,296,720 B1 10/2001 Yamamoto et al.
6,444,048 B1 9/2002 Hasegawa et al.

(Continued)

FOREIGN PATENT DOCUMENTS

CN 1258082 6/2000

(Continued)

OTHER PUBLICATIONS

Kim, et al., "Microstructure of ZR Containing NdFeB" -IEEE, vol. 33, No. 5, Sep. 1997, pp. 3823-3825.

(Continued)

*Primary Examiner*—John P. Sheehan
(74) *Attorney, Agent, or Firm*—Hogan & Hartson LLP

(57) ABSTRACT

A method for manufacturing an R-T-B system rare earth permanent magnet that is a sintered body comprising a main phase consisting of an $R_2T_{14}B$ phase (wherein R represents one or more rare earth elements (providing that the rare earth elements include Y), and T represents one or more transition metal elements essentially containing Fe, or Fe and Co), and a grain boundary phase containing a higher amount of R than the above main phase, wherein a product that is rich in Zr exists in the above $R_2T_{14}B$ phase, the above manufacturing method comprising the steps of: preparing an R-T-B alloy containing as a main component the $R_2T_{14}B$ phase and also containing Zr, and an R-T alloy containing R and T as main components, wherein the amount of R is higher than that of the above R-T-B alloy; obtaining a mixture of the R-T-B alloy powder and the R-T alloy powder; preparing a compacted body with a certain form from the above mixture; and sintering the above compacted body, wherein, in the above sintering step, the above product is generated in the above $R_2T_{14}B$ phase.

4 Claims, 20 Drawing Sheets

| | ADDITIVE ELEMENT M | ADDITIVE AMOUNT OF M [wt%] | PRESENCE OR ABSENCE OF INTRAPHASE PRODUCT | Br [kG] | HcJ [kOe] | Hk/HcJ [%] |
|---|---|---|---|---|---|---|
| REFERENCE EXAMPLE | — | 0 | × | 14.03 | 12.92 | 51.7 |
| EXAMPLE 1 | Zr | 0.02 | O | 13.94 | 13.29 | 81.8 |
| | | 0.03 | | 13.97 | 13.39 | 96.5 |
| | | 0.05 | | 13.96 | 13.56 | 97.5 |
| | | 0.10 | | 13.95 | 13.62 | 96.3 |
| | | 0.20 | | 13.86 | 13.75 | 96.3 |
| COMPARATIVE EXAMPLE 1 | Ti | 0.03 | O | 13.95 | 13.00 | 85.0 |
| | | 0.05 | | 13.90 | 12.85 | 98.2 |
| | | 0.10 | | 13.81 | 12.85 | 98.2 |
| | | 0.15 | | 13.75 | 13.08 | 97.9 |
| | | 0.20 | | 13.67 | 13.31 | 97.6 |
| COMPARATIVE EXAMPLE 2 | Zr | 0.05 | × | 13.99 | 13.56 | 63.0 |
| | | 0.10 | | 13.90 | 13.43 | 85.2 |
| | | 0.20 | | 13.73 | 13.36 | 96.6 |
| COMPARATIVE EXAMPLE 3 | Zr | 0 | × | 14.05 | 12.34 | 53.5 |
| | | 0.05 | | 13.98 | 12.58 | 73.3 |
| | | 0.10 | | 13.92 | 12.64 | 88.3 |
| | | 0.20 | | 13.78 | 12.67 | 96.6 |

U.S. PATENT DOCUMENTS

| | | | | |
|---|---|---|---|---|
| 6,468,365 | B1 | 10/2002 | Uchida et al. | |
| 6,506,265 | B2 * | 1/2003 | Yamamoto et al. | 148/302 |
| 2002/0007875 | A1 * | 1/2002 | Yamamoto et al. | 148/302 |
| 2004/0079449 | A1 * | 4/2004 | Kanekiyo et al. | 148/302 |
| 2004/0187962 | A1 * | 9/2004 | Ishizaka et al. | 148/101 |

FOREIGN PATENT DOCUMENTS

| | | | |
|---|---|---|---|
| EP | 0 197 712 | * | 10/1986 |
| EP | 1 164 599 | | 12/2001 |
| EP | 1 164 599 | A2 * | 12/2001 |
| JP | 01-219143 | | 9/1989 |
| JP | 10-041113 | | 2/1998 |
| JP | 10-259459 | | 9/1998 |
| JP | 2002-075717 | | 3/2002 |

OTHER PUBLICATIONS

Pollard, et al., "Effect of ZR Additions on the Microstructural and Magnetic Properties of NDFEB Based Magnets"—IEEE Transactions on Magnetics, New York, US, Mar. 1988, No. 2, pp. 1626-1628.

Besenicar, S., "The Influence of ZR02 Addition on the Microstructure and the Magnetic Properties of ND-DY-FE-B Magnets" —Journal of Magnetism and Magnetic Materials, Amsterdam, NL, Feb. 1992, Part II, pp. 1175-1178.

McGuiness, et al., "Magnetic Properties and Microstructure in NdDyFeBZr-HDDR"—Journal of Magnetism and Magnetic Materials 188 (1998) pp. 119-124.

* cited by examiner

FIG. 1

| | | Nd [wt%] | Pr [wt%] | Dy [wt%] | Co [wt%] | Cu [wt%] | Al [wt%] | B [wt%] | M(Zr,Ti) [wt%] | $O_2$ [ppm] | $N_2$ [ppm] | Fe | THICKNESS OF ALLOYS |
|---|---|---|---|---|---|---|---|---|---|---|---|---|---|
| EXAMPLE 1 | LOW R ALLOY | 23.6 | 6.0 | 0.3 | — | 0.05 | 0.23 | 1.1 | 0～0.22(Zr) | — | — | bal. | 250～340 μm |
| | HIGH R ALLOY | 40.6 | — | — | 5.0 | 0.05 | 0.23 | — | — | — | — | bal. | 530 μm |
| | COMPOSITION OF SINTERED BODY | 25.0 | 5.3 | 0.3 | 0.5 | 0.05 | 0.23 | 1.0 | 0～0.20(Zr) | 670 | 300 | bal. | — |
| COMPARATIVE EXAMPLE 1 | LOW R ALLOY | 23.6 | 6.0 | 0.3 | — | 0.05 | 0.23 | 1.1 | 0～0.22(Ti) | — | — | bal. | 250～340 μm |
| | HIGH R ALLOY | 40.6 | — | — | 5.0 | 0.05 | 0.23 | — | — | — | — | bal. | 530 μm |
| | COMPOSITION OF SINTERED BODY | 25.0 | 5.3 | 0.3 | 0.5 | 0.05 | 0.23 | 1.0 | 0～0.20(Ti) | 780 | 320 | bal. | — |
| COMPARATIVE EXAMPLE 2 | LOW R ALLOY | 23.6 | 6.0 | 0.3 | — | 0.05 | 0.23 | 1.1 | - | — | — | bal. | 310 μm |
| | HIGH R ALLOY | 40.6 | — | — | 5.0 | 0.05 | 0.23 | 0.5 | 0～2.0(Zr) | — | — | bal. | 470～550 μm |
| | COMPOSITION OF SINTERED BODY | 25.0 | 5.3 | 0.3 | 0.5 | 0.05 | 0.23 | 1.0 | 0～0.20(Zr) | 920 | 350 | bal. | — |
| COMPARATIVE EXAMPLE 3 | LOW R ALLOY | 23.6 | 6.0 | 0.3 | — | 0.05 | 0.23 | 1.1 | 0～0.22(Zr) | — | — | bal. | 470～550 μm |
| | HIGH R ALLOY | 40.6 | — | — | 5.0 | 0.05 | 0.23 | — | — | — | — | bal. | 530 μm |
| | COMPOSITION OF SINTERED BODY | 25.0 | 5.3 | 0.3 | 0.5 | 0.05 | 0.23 | 1.0 | 0～0.20(Zr) | 630 | 290 | bal. | — |

FIG. 2

| | ADDITIVE ELEMENT M | ADDITIVE AMOUNT OF M [wt%] | PRESENCE OR ABSENCE OF INTRAPHASE PRODUCT | Br [kG] | HcJ [kOe] | Hk/HcJ [%] |
|---|---|---|---|---|---|---|
| REFERENCE EXAMPLE | — | 0 | × | 14.03 | 12.92 | 51.7 |
| EXAMPLE 1 | Zr | 0.02 | ○ | 13.94 | 13.29 | 81.8 |
| | | 0.03 | | 13.97 | 13.39 | 96.5 |
| | | 0.05 | | 13.96 | 13.56 | 97.5 |
| | | 0.10 | | 13.95 | 13.62 | 96.3 |
| | | 0.20 | | 13.86 | 13.75 | 96.3 |
| COMPARATIVE EXAMPLE 1 | Ti | 0.03 | ○ | 13.95 | 13.00 | 85.0 |
| | | 0.05 | | 13.90 | 12.85 | 98.2 |
| | | 0.10 | | 13.81 | 12.85 | 98.2 |
| | | 0.15 | | 13.75 | 13.08 | 97.9 |
| | | 0.20 | | 13.67 | 13.31 | 97.6 |
| COMPARATIVE EXAMPLE 2 | Zr | 0.05 | × | 13.99 | 13.56 | 63.0 |
| | | 0.10 | | 13.90 | 13.43 | 85.2 |
| | | 0.20 | | 13.73 | 13.36 | 96.6 |
| COMPARATIVE EXAMPLE 3 | Zr | 0 | × | 14.05 | 12.34 | 53.5 |
| | | 0.05 | | 13.98 | 12.58 | 73.3 |
| | | 0.10 | | 13.92 | 12.64 | 88.3 |
| | | 0.20 | | 13.78 | 12.67 | 96.6 |

FIG. 12

| | ADDITIVE ELEMENT M | ADDING METHOD OF M | ADDITIVE AMOUNT OF M [wt%] | PRESENCE OR ABSENCE OF INTRAPHASE PRODUCT | SINTERING TEMPERATURE [°C] | Br [kG] | HcJ [kOe] | Hk/HcJ [%] |
|---|---|---|---|---|---|---|---|---|
| REFERENCE EXAMPLE | — | — | 0 | × | 1010 | 13.85 | 11.87 | 84.2 |
| | | | | | 1030 | 13.91 | 12.22 | 85.6 |
| | | | | | 1050 | 13.93 | 13.25 | 88.7 |
| | | | | | 1070 | 14.03 | 12.92 | 51.7 |
| | | | | | 1090 | 14.01 | 12.13 | 39.1 |
| EXAMPLE 2 | Zr | LOW R ALLOYS | 0.1 | ○ | 1010 | 13.81 | 12.56 | 86.3 |
| | | | | | 1030 | 13.92 | 13.26 | 96.1 |
| | | | | | 1050 | 13.93 | 13.52 | 97.0 |
| | | | | | 1070 | 13.95 | 13.62 | 96.3 |
| | | | | | 1090 | 13.90 | 13.42 | 96.0 |
| COMPARATIVE EXAMPLE 4 | Ti | LOW R ALLOYS | 0.1 | ○ | 1010 | 13.74 | 12.13 | 88.4 |
| | | | | | 1030 | 13.74 | 13.05 | 95.3 |
| | | | | | 1050 | 13.75 | 13.18 | 96.2 |
| | | | | | 1070 | 13.76 | 13.08 | 97.9 |
| | | | | | 1090 | 13.71 | 12.68 | 91.3 |
| COMPARATIVE EXAMPLE 5 | Zr | HIGH R ALLOYS | 0.1 | × | 1010 | 13.84 | 12.24 | 86.3 |
| | | | | | 1030 | 13.85 | 12.34 | 88.7 |
| | | | | | 1050 | 13.87 | 13.20 | 91.5 |
| | | | | | 1070 | 13.90 | 13.18 | 90.1 |
| | | | | | 1090 | 13.75 | 12.56 | 75.3 |

FIG. 17

| | | Nd [wt%] | Pr [wt%] | Dy [wt%] | Co [wt%] | Cu [wt%] | Al [wt%] | B [wt%] | Zr [wt%] | $O_2$ [ppm] | $N_2$ [ppm] | Fe | ROLL PERIPHERAL VELOCITY [m/s] | THICKNESS OF ALLOYS [μm] |
|---|---|---|---|---|---|---|---|---|---|---|---|---|---|---|
| SAMPLE A | LOW R ALLOY | 23.6 | 6.0 | 0.3 | — | 0.05 | 0.23 | 1.1 | 0.09 | — | — | bal. | 1.0 | 370 |
| | HIGH R ALLOY | 40.6 | — | — | 5.0 | 0.05 | 0.23 | — | — | — | — | bal. | 0.6 | 520 |
| | COMPOSITION OF SINTERED BODY | 25.0 | 5.3 | 0.3 | 0.5 | 0.05 | 0.23 | 1.0 | 0.08 | 980 | 380 | bal. | — | — |
| SAMPLE B | LOW R ALLOY | 23.0 | 5.7 | 0.4 | — | 0.05 | 0.18 | 1.1 | 0.12 | — | — | bal. | 1.8 | 240 |
| | HIGH R ALLOY | 40.6 | — | — | 5.0 | 0.05 | 0.23 | — | — | — | — | bal. | 0.6 | 520 |
| | COMPOSITION OF SINTERED BODY | 24.8 | 5.1 | 0.4 | 0.5 | 0.05 | 0.19 | 1.0 | 0.11 | 720 | 440 | bal. | — | — |
| SAMPLE C | LOW R ALLOY | 22.5 | 6.2 | 0.4 | — | 0.05 | 0.23 | 1.1 | 0.20 | — | — | bal. | 1.6 | 270 |
| | HIGH R ALLOY | 40.6 | — | — | 5.0 | 0.05 | 0.23 | — | — | — | — | bal. | 0.6 | 520 |
| | COMPOSITION OF SINTERED BODY | 24.3 | 5.6 | 0.4 | 0.5 | 0.05 | 0.23 | 1.0 | 0.18 | 870 | 420 | bal. | — | — |
| SAMPLE D | LOW R ALLOY | 22.7 | 5.9 | 1.3 | — | 0.05 | 0.23 | 1.1 | 0.20 | — | — | bal. | 1.5 | 320 |
| | HIGH R ALLOY | 30.3 | — | 10.0 | 5.0 | 0.05 | 0.15 | — | — | — | — | bal. | 0.6 | 550 |
| | COMPOSITION OF SINTERED BODY | 23.5 | 5.3 | 2.2 | 0.5 | 0.05 | 0.22 | 1.0 | 0.18 | 680 | 390 | bal. | — | — |

FIG. 18

| | SINTERING TEMPERATURE [°C] | Br [kG] | HcJ [kOe] | Hk/HcJ [%] |
|---|---|---|---|---|
| SAMPLE A | 1010 | 14.05 | 11.13 | 88.6 |
| | 1030 | 14.06 | 14.61 | 95.0 |
| | 1050 | 14.14 | 14.61 | 97.0 |
| | 1070 | 14.14 | 13.45 | 95.2 |
| | 1090 | 14.22 | 4.26 | 44.0 |
| SAMPLE B | 1010 | 14.03 | 11.85 | 88.0 |
| | 1030 | 14.10 | 14.67 | 95.6 |
| | 1050 | 14.13 | 14.71 | 96.4 |
| | 1070 | 14.15 | 14.35 | 97.5 |
| | 1090 | 14.08 | 13.52 | 96.0 |
| SAMPLE C | 1010 | 13.98 | 12.81 | 87.3 |
| | 1030 | 14.07 | 14.67 | 95.3 |
| | 1050 | 14.08 | 14.72 | 96.1 |
| | 1070 | 14.08 | 14.70 | 98.2 |
| | 1090 | 14.08 | 14.61 | 97.9 |
| SAMPLE D | 1010 | 13.90 | 14.31 | 95.6 |
| | 1030 | 13.90 | 16.07 | 97.8 |
| | 1050 | 13.90 | 16.18 | 97.9 |
| | 1070 | 13.91 | 16.22 | 97.8 |
| | 1090 | 13.92 | 15.83 | 72.1 |

FIG. 19

| | | Nd [wt%] | Pr [wt%] | Dy [wt%] | Co [wt%] | Cu [wt%] | Al [wt%] | B [wt%] | Zr [wt%] | $O_2$ [ppm] | $N_2$ [ppm] | Fe |
|---|---|---|---|---|---|---|---|---|---|---|---|---|
| SAMPLE E | LOW R ALLOY | 27.9 | – | 0.1 | — | 0.03 | 0.05 | 1.1 | 0.08 | — | — | bal. |
| | HIGH R ALLOY | 35.1 | – | – | 2.0 | 0.03 | 0.05 | – | — | — | — | bal. |
| | COMPOSITION OF SINTERED BODY | 28.3 | – | 0.1 | 0.2 | 0.03 | 0.05 | 1.0 | 0.07 | 720 | 360 | bal. |
| SAMPLE F | LOW R ALLOY | 23.7 | 6.0 | 0.2 | — | 0.30 | 0.25 | 1.6 | 0.30 | — | — | bal. |
| | HIGH R ALLOY | 40.6 | — | – | 20.0 | 0.30 | 0.25 | — | — | — | — | bal. |
| | COMPOSITION OF SINTERED BODY | 26.9 | 4.8 | 0.2 | 4.0 | 0.30 | 0.25 | 1.3 | 0.24 | 980 | 450 | bal. |

FIG. 20

| | Br [kG] | HcJ [kOe] | Hk/HcJ [%] |
|---|---|---|---|
| SAMPLE E | 14.62 | 13.10 | 98.0 |
| SAMPLE F | 13.88 | 15.30 | 96.0 |
| SAMPLE A | 14.14 | 13.45 | 95.2 |
| SAMPLE B | 14.15 | 14.35 | 97.5 |
| SAMPLE C | 14.08 | 14.70 | 98.2 |
| SAMPLE D | 13.91 | 16.22 | 97.8 |

METHOD FOR MANUFACTURING R-T-B SYSTEM RARE EARTH PERMANENT MAGNET

BACKGROUND OF THE INVENTION

1. Field of the Invention

The present invention relates to a method for manufacturing an R-T-B system rare earth permanent magnet containing, as main components, R (wherein R represents one or more rare earth elements, providing that the rare earth elements include Y), T (wherein T represents at least one transition metal element essentially containing Fe, or Fe and Co), and B (boron).

2. Description of the Related Art

Among rare earth permanent magnets, an R-T-B system rare earth permanent magnet has been increasingly demanded year by year for the reasons that its magnetic properties are excellent and that its main component Nd is abundant as a source and relatively inexpensive.

Research and development directed towards the improvement of the magnetic properties of the R-T-B system rare earth permanent magnet have intensively progressed. For example, Japanese Patent Laid-Open No. 1-219143 discloses that the addition of 0.02 to 0.5 at % of Cu improves magnetic properties of the R-T-B system rare earth permanent magnet as well as heat treatment conditions. However, the method described in Japanese Patent Laid-Open No. 1-219143 is insufficient to obtain high magnetic properties required of a high performance magnet, such as a high coercive force (HcJ) and a high residual magnetic flux density (Br).

The magnetic properties of an R-T-B system rare earth permanent magnet obtained by sintering depend on the sintering temperature. On the other hand, it is difficult to equalize the heating temperature throughout all parts of a sintering furnace in the scale of industrial manufacturing. Thus, the R-T-B system rare earth permanent magnet is required to obtain desired magnetic properties even when the sintering temperature is changed. A temperature range in which desired magnetic properties can be obtained is referred to as a suitable sintering temperature range herein.

In order to obtain a higher-performance R-T-B system rare earth permanent magnet, it is necessary to decrease the amount of oxygen contained in alloys. However, if the amount of oxygen contained in the alloys is decreased, abnormal grain growth is likely to occure in a sintering process, resulting in a decrease in a squareness. This is because oxides formed by oxygen contained in the alloys inhibit the grain growth.

Thus, a method of adding a new element to the R-T-B system rare earth permanent magnet containing Cu has been studied as means for improving the magnetic properties. Japanese Patent Laid-Open No. 2000-234151 discloses the addition of Zr and/or Cr to obtain a high coercive force and a high residual magnetic flux density.

Likewise, Japanese Patent Laid-Open No. 2002-75717 discloses a method of uniformly dispersing a fine ZrB compound, NbB compound or HfB compound (hereinafter referred to as an M-B compound) into an R-T-B system rare earth permanent magnet containing Zr, Nb or Hf as well as Co, Al and Cu, followed by precipitation, so as to inhibit the grain growth in a sintering process and to improve magnetic properties and the suitable sintering temperature range.

According to Japanese Patent Laid-Open No. 2002-75717, the suitable sintering temperature range is extended by the dispersion and precipitation of the M-B compound.

However, in Example 3-1 described in the above publication, the suitable sintering temperature range is narrow, such as approximately 20° C. Accordingly, to obtain high magnetic properties using amass-production furnace or the like, it is desired to further extend the suitable sintering temperature range. Moreover, in order to obtain a sufficiently wide suitable sintering temperature range, it is effective to increase the additive amount of Zr. However, as the additive amount of Zr increases, the residual magnetic flux density decreases, and thus, high magnetic properties of interest cannot be obtained.

SUMMARY OF THE INVENTION

Hence, it is an object of the present invention to provide a method for manufacturing an R-T-B system rare earth permanent magnet, which enables to inhibit the grain growth, while keeping a decrease in magnetic properties to a minimum, and also enables to further improve the suitable sintering temperature range.

The present inventors have found that when an R-T-B system rare earth permanent magnet contains Zr in a specific form, more specifically when a product that is rich in Zr exists in an $R_2T_{14}B$ phase constituting the main phase of an R-T-B system rare earth permanent magnet, the permanent magnet enables to inhibit the grain growth, while keeping a decrease in magnetic properties to a minimum, and to improve the suitable sintering temperature range. It is important for this R-T-B system rare earth permanent magnet to generate the Zr rich product in the $R_2T_{14}B$ phase (hereinafter referred to as an intraphase product at times) during a sintering step in a method for manufacturing the R-T-B system rare earth permanent magnet. The method for manufacturing the R-T-B system rare earth permanent magnet comprises the steps of: preparing an R-T-B alloy containing as a main component the $R_2T_{14}B$ phase (wherein R represents one or more rare earth elements (providing that the rare earth elements include Y), and T represents one or more transition metal elements essentially containing Fe, or Fe and Co) and also containing Zr, and an R-T alloy containing R and T as main components, wherein the amount of R is higher than that of the R-T-B alloy; obtaining a mixture of the R-T-B alloy powder and the R-T alloy powder; preparing a compacted body with a certain form from the mixture; and sintering the compacted body. The intraphase product is platy or acicular.

The sintered body of the present invention preferably has a composition consisting essentially of 25% to 35% by weight of R, 0.5% to 4.5% by weight of B, 0.02% to 0.6% by weight of Al and/or Cu, 0.03% to 0.25% by weight of Zr, 4% or less by weight (excluding 0) of Co, and the balance substantially being Fe. More preferably, it has a composition consisting essentially of 28% to 33% by weight of R, 0.5% to 1.5% by weight of B, 0.03% to 0.3% by weight of Al, 0.03% to 0.15% by weight of Cu, 0.05% to 0.2% by weight of Zr, 0.1% to 2.0% or less by weight of Co, and the balance substantially being Fe. It is especially desirable that the amount of Zr is 0.1 to 0.15% by weight.

BRIEF DESCRIPTION OF THE DRAWINGS

FIG. 1 is a table showing the combinations of low R alloys and high R alloys used in Embodiment Example 1, and the compositions of the obtained permanent magnets;

FIG. 2 is a table showing the magnetic properties of the permanent magnets obtained in Embodiment Example 1;

FIG. 12 is a table showing the magnetic properties of the permanent magnets obtained in Embodiment Example 2;

FIG. 17 is a table showing the combinations of low R alloys and high R alloys used in Embodiment Example 3, and the compositions of the obtained permanent magnets;

FIG. 18 is a table showing the magnetic properties of the permanent magnets obtained in Embodiment Example 3;

FIG. 19 is a table showing the combinations of low R alloys and high R alloys used in Embodiment Example 4, and the compositions of the obtained permanent magnets;

FIG. 20 is a table showing the magnetic properties of the permanent magnets obtained in Embodiment Example 4.

DETAILED DESCRIPTION OF THE PREFERRED EMBODIMENTS

Figure 3:
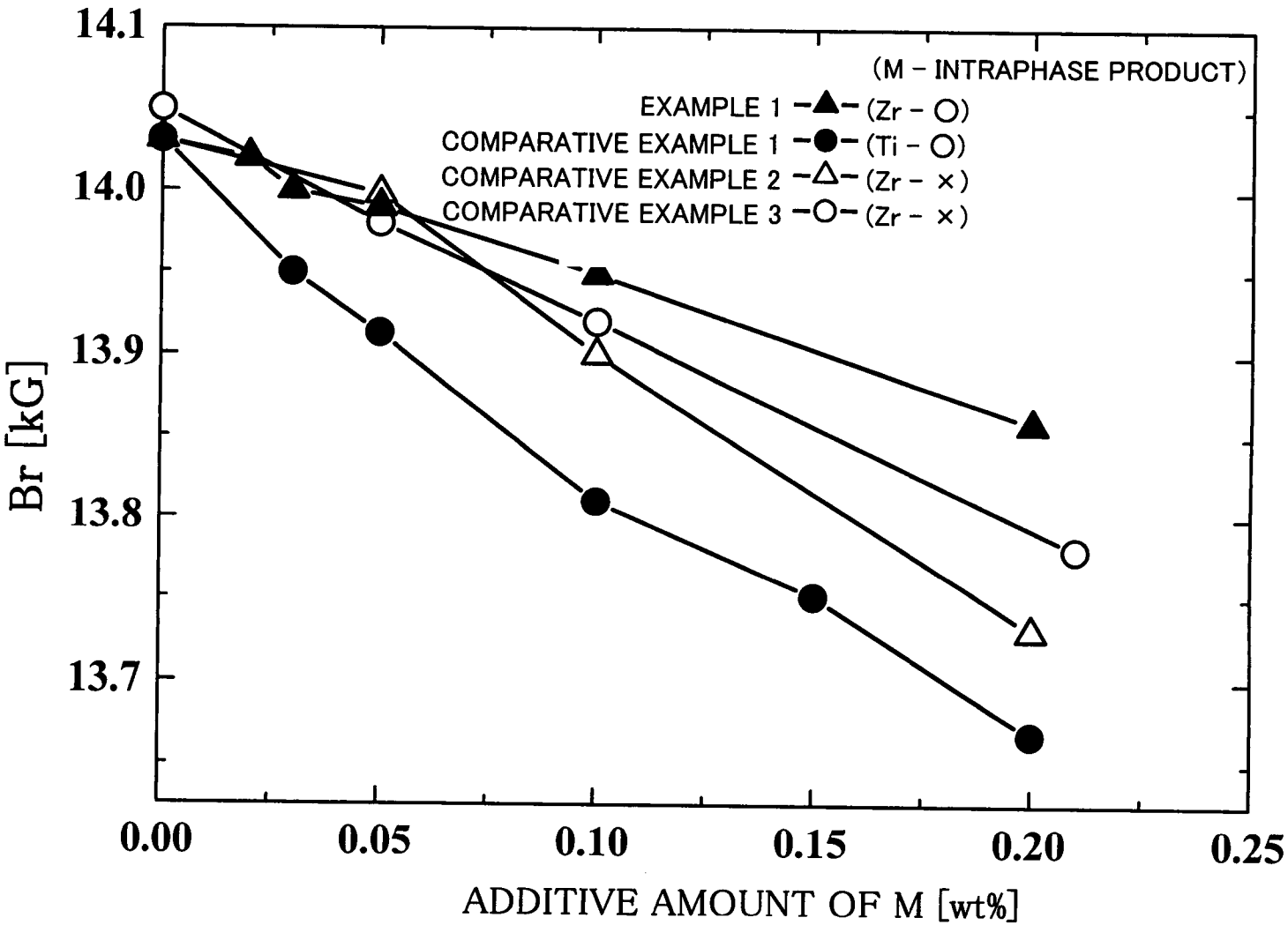
FIG. 3 is a graph showing the relationship between the amount of additive element M (Zr or Ti) and the residual magnetic flux density (Br) of each of the permanent magnets obtained in Embodiment Example 1.
Figure 4:
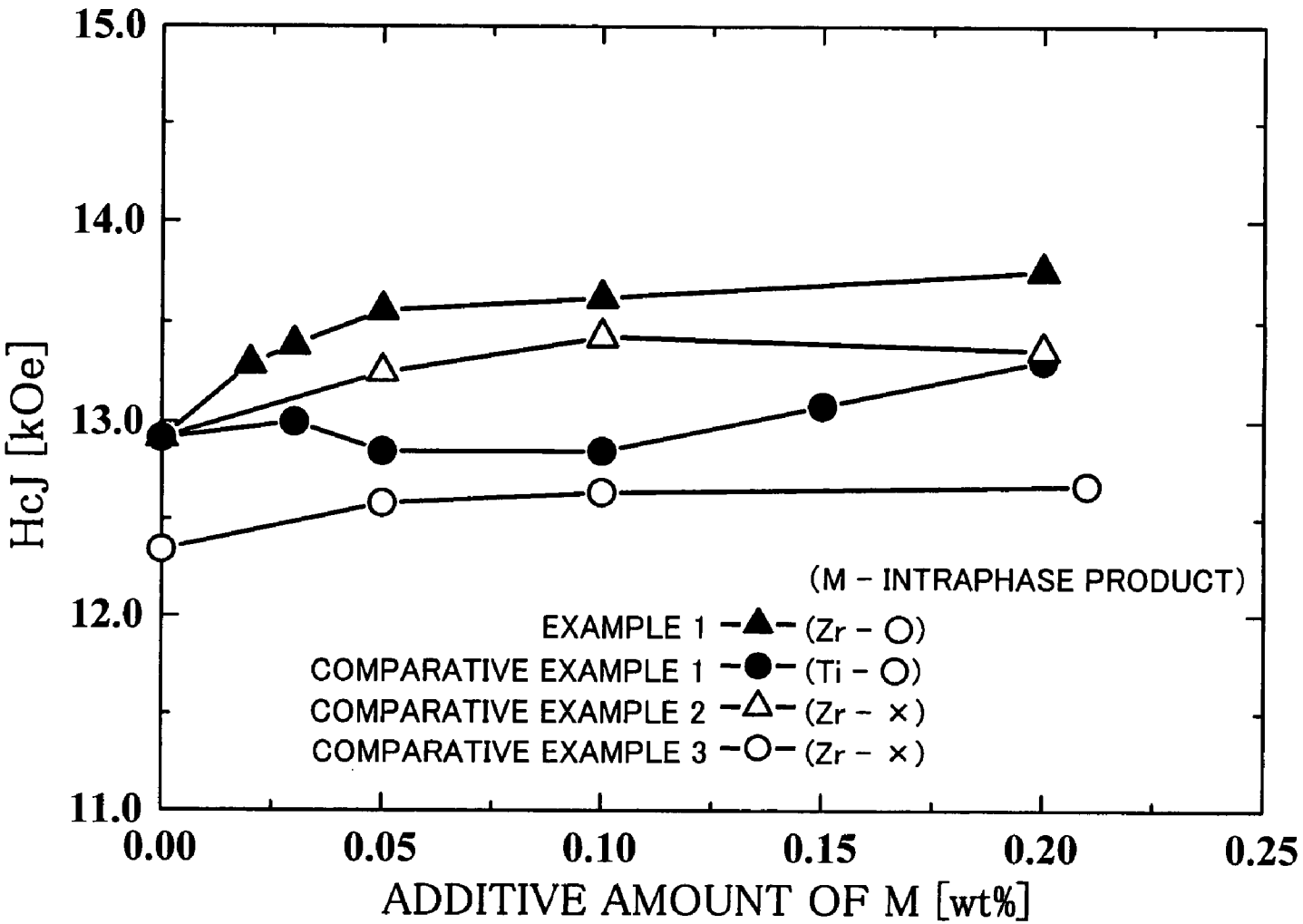
FIG. 4 is a graph showing the relationship between the amount of additive element M (Zr or Ti) and the coercive force (HcJ) of each of the permanent magnets obtained in Embodiment Example 1.

The embodiments of the present invention will be described below.

<Microstructure>

As is well known, the R-T-B system rare earth permanent magnet of the present invention at least comprises a main phase consisting of an $R_2T_{14}B$ phase (wherein R represents one or more rare earth elements (providing that the rare earth elements include Y), and T represents one or more transition metal elements essentially containing Fe, or Fe and Co), and a grain boundary phase containing a higher amount of R than the main phase. The present invention is characterized in that a product that is rich in Zr exists in the $R_2T_{14}B$ phase. The R-T-B system rare earth permanent magnet containing this product enables to inhibit the grain growth, while keeping a decrease in magnetic properties to a minimum, and to extend the suitable sintering temperature range. This product needs to exist in the $R_2T_{14}B$ phase, but it is not required to exist in all the $R_2T_{14}B$ phases. This product may exist also in the grain boundary phase. However, when the Zr rich product exists only in the grain boundary phase, the effects of the present invention cannot be obtained.

In the R-T-B system rare earth permanent magnet, Ti has conventionally been known as an additive element that forms the product in the $R_2T_{14}B$ phase (e.g., J. Appl. Phys. 69 (1991) 6055). The present inventors have found that the formation of the product in the $R_2T_{14}B$ phase by addition of Zr or Ti is effective for the extension of a suitable sintering temperature range. In the case of adding Zr, although Zr is added in an amount necessary to obtain such an effect as the extension of a suitable sintering temperature range, it causes almost no decrease in magnetic properties, and more specifically, almost no decrease in the residual magnetic flux density (Br). On the other hand, in the case of adding Ti, if this element is added in an amount necessary to obtain such an effect as the extension of a suitable sintering temperature range, the residual magnetic flux density (Br) is significantly decreased, and thus, it is clear that the addition of Ti is not practically preferable. As stated above, when the composition of the product is rich in Zr, it makes possible to consistently produce permanent magnets with high magnetic properties in a wide suitable sintering temperature range.

The present inventors have confirmed that in order to allow the product that is rich in Zr to exist in the $R_2T_{14}B$ phase, there are several requirements on the manufacturing method. The procedure of the manufacturing method of the permanent magnet of the present invention will be described later. The requirements to allow the Zr rich product to exist in the $R_2T_{14}B$ phase will be explained below.

There are two methods for manufacturing an R-T-B system rare earth permanent magnet: a method of using as a starting alloy a single alloy having a desired composition (hereinafter referred to as a single method), and a method of using as starting alloys a plurality of alloys having different compositions (hereinafter referred to as a mixing method). In the mixing method, alloys containing an $R_2T_{14}B$ phase as a main constituent (low R alloys) and alloys containing a higher amount of R than the low R alloys (high R alloys) are typically used, as starting alloys.

The present inventors added Zr to either the low R alloys or the high R alloys, so as to obtain an R-T-B system rare earth permanent magnet. As a result, the present inventors confirmed that when Zr is added to the low R alloys in order to produce a permanent magnet, the product that is rich in Zr exists in the $R_2T_{14}B$ phase. The present inventors also confirmed that when Zr is added to the high R alloys, the Zr rich product does not exist in the $R_2T_{14}B$ phase.

Moreover, even in the case where Zr is added to the low R alloys, if the Zr rich product existed in the $R_2T_{14}B$ phase in the low R alloy stage, it was not confirmed that the Zr rich product exists in the $R_2T_{14}B$ phase after a sintering process, although it existed in an R rich phase (grain boundary phase) located at a triple point in the microstructure of the sintered bodies. Accordingly, in order to allow the Zr rich product to exist in the $R_2T_{14}B$ phase of the R-T-B system rare earth permanent magnet, it is important not to allow the Zr rich product to exist in the $R_2T_{14}B$ phase in the mother alloy stage.

On that account, a method for manufacturing mother alloys should be considered. When the low R alloys are manufactured by the strip casting method, the peripheral velocity of a chill roll needs to be controlled. When the peripheral velocity of a chill roll is low, it results in the deposition of α-Fe, and the Zr rich product is generated in the $R_2T_{14}B$ phase of the low R alloys. As a result of studies of the present inventors, it was found that when the peripheral velocity of a chill roll is within the range between 1.0 and 1.8 m/s, low R alloys in which the Zr rich product do not exist in the $R_2T_{14}B$ phase can be obtained. Using the obtained low R alloys, a permanent magnet with high magnetic properties can be obtained.

Furthermore, even in the case of obtaining low R alloys in which the Zr rich product does not exist in the $R_2T_{14}B$ phase, it is not desired in the present invention that the obtained low R alloys are subjected to a heat treatment and then used as mother alloys. This is because the Zr rich product is generated in the $R_2T_{14}B$ phase of the low R alloys as a result of undergoing a heat treatment in a temperature area (approximately 700° C. or higher) where the microstructure of the low R alloys may be modified.

<Chemical Composition>

Next, a desired composition of the R-T-B system rare earth permanent magnet of the present invention will be explained. The term chemical composition is used herein to mean a chemical composition obtained after sintering.

The rare earth permanent magnet of the present invention contains 25% to 35% by weight of R.

The term R is used herein to mean one or more rare earth elements selected from a group consisting of La, Ce, Pr, Nd, Sm, Eu, Gd, Tb, Dy, Ho, Er, Yb, Lu and Y. If the amount of R is less than 25% by weight, an $R_2T_{14}B$, phase as a main phase of the rare earth permanent magnet is not sufficiently generated. Accordingly, α-Fe or the like having soft magnetism is deposited and the coercive force significantly decreases. On the other hand, if the amount of R exceeds 35% by weight, the volume ratio of the $R_2T_{14}B$ phase as a main phase decreases, and the residual magnetic flux density decreases. Moreover, if the amount of R exceeds 35% by weight, R reacts with oxygen, and the content of oxygen thereby increases. In accordance with the increase of the oxygen content, an R rich phase effective for the generation of coercive force decreases, resulting in a reduction in the coercive force. Therefore, the amount of R is set between 25% and 35% by weight. The amount of R is preferably between 28% and 33% by weight, and more preferably between 29% and 32% by weight.

Since Nd is abundant as a source and relatively inexpensive, it is preferable to use Nd as a main component of R. Moreover, since the containment of Dy increases an anisotropic magnetic field, it is effective to contain Dy to improve the coercive force. Accordingly, it is desired to select Nd and Dy for R and to set the total amount of Nd and Dy between 25% and 33% by weight. In addition, in the above range, the amount of Dy is preferably between 0.1% and 8% by weight. It is desired that the amount of Dy is arbitrarily determined within the above range, depending on which is more important, a residual magnetic flux density or a coercive force. This is to say, when a high residual magnetic flux density is required to be obtained, the amount of Dy is preferably set between 0.1% and 3.5% by weight. When a high coercive force is required to be obtained, it is preferably set between 3.5% and 8% by weight.

Moreover, the rare earth permanent magnet of the present invention contains 0.5% to 4.5% by weight of boron (B). If the amount of B is less than 0.5% by weight, a high coercive force cannot be obtained. However, if the amount of B exceeds 4.5% by weight, the residual magnetic flux density is likely to decrease. Accordingly, the upper limit is set at 4.5% by weight. The amount of B is preferably between 0.5% and 1.5% by weight, and more preferably between 0.8% and 1.2% by weight.

The R-T-B system rare earth permanent magnet of the present invention may contain Al and/or Cu within the range between 0.02% and 0.6% by weight. The containment of Al and/or Cu within the above range can impart a high coercive force, a strong corrosion resistance, and an improved temperature stability of magnetic properties to the obtained permanent magnet. When Al is added, the additive amount of Al is preferably between 0.03% and 0.3% by weight, and more preferably between 0.05% and 0.25% by weight. When Cu is added, the additive amount of Cu is 0.3% or less by weight (excluding 0), preferably 0.15% or less by weight (excluding 0), and more preferably between 0.03% and 0.08% by weight.

In order to allow the Zr rich product to exist in the $R_2T_{14}B$ phase, the R-T-B system rare earth permanent magnet of the present invention preferably contains Zr within the range between 0.03% and 0.25% by weight. When the content of oxygen is reduced to improve the magnetic properties of the R-T-B system rare earth permanent magnet, Zr exerts the effect of inhibiting the abnormal grain growth in a sintering process and thereby makes the microstructure of the sintered body uniform and fine. Accordingly, when the amount of oxygen is low, Zr fully exerts its effect. The amount of Zr is preferably between 0.05% and 0.2% by weight, and more preferably between 0.1% and 0.15% by weight.

The R-T-B system rare earth permanent magnet of the present invention contains 2,000 ppm or less oxygen. If it contains a large amount of oxygen, an oxide phase that is a non-magnetic component increases, thereby decreasing magnetic properties. Thus, in the present invention, the amount of oxygen contained in a sintered body is set at 2,000 ppm or less, preferably 1,500 ppm or less, and more preferably 1,000 ppm or less. However, when the amount of oxygen is simply decreased, an oxide phase having a grain growth inhibiting effect decreases, so that the grain growth easily occures in a process of obtaining full density increase during sintering. Thus, in the present invention, the R-T-B system rare earth permanent magnet to contains a certain amount of Zr, which exerts the effect of inhibiting the abnormal grain growth in a sintering process.

The R-T-B system rare earth permanent magnet of the present invention contains Co in an amount of 4% or less by weight (excluding 0), preferably between 0.1% and 2.0% by weight, and more preferably between 0.3% and 1.0% by weight. Co forms a phase similar to that of Fe. Co has an effect to improve Curie temperature and the corrosion resistance of a grain boundary phase.

<Manufacturing Method>

Next, desired embodiments of the method for manufacturing an R-T-B system permanent magnet of the present invention will be explained.

In the present invention, the R-T-B system permanent magnet is manufactured by using alloys (low R alloys) containing an $R_2T_{14}B$ phase as a main constituent and other alloys (high R alloys) containing a higher amount of R than the low R alloys.

Raw material is first subjected to strip casting in a vacuum or an inert gas atmosphere, or preferably an Ar atmosphere, so that low R alloys and high R alloys are obtained. As stated above, it is necessary to give special consideration to the obtained strips, especially to the strips of the low R alloys, so that a Zr rich product is not generated in the $R_2T_{14}B$ phase. More specifically, the peripheral velocity of a chill roll is set within the range between 1.0 and 1.8 m/s. The preferred peripheral velocity of a chill roll is between 1.2 and 1.5 m/s.

It is important for the present invention not to allow a Zr rich product to generate in an $R_2T_{14}B$ phase during the period from the achievement of low R alloys having the $R_2T_{14}B$ phase in which the present Zr rich product does not exist until a sintering process described later. In other words, it is important for the present invention to maintain the form of the above $R_2T_{14}B$ phase. For example, it is preferable not to carry out a heat treatment, in which the low R alloys are heated to 700° C. or higher and retained, before crushing processes that begin with hydrogen crushing. This point will be further described in Embodiment Example 1 described later.

The feature of the present embodiment is that Zr is added to low R alloys. As explained above in the column <Microstructure>, the reason is that the Zr rich product can be allowed to exist in the $R_2T_{14}B$ phase of the R-T-B system rare earth permanent magnet by adding Zr to low R alloys containing no Zr rich products in an $R_2T_{14}B$ phase thereof. The low R alloys can contain Cu and Al, in addition to rare earth elements, Fe, Co and B. Moreover, the high R alloys can also contain Cu and Al, in addition to rare earth element, Fe, Co and B. Moreover, the high R alloys can also contain Cu and Al, in addition to rare earth elements, Fe and Co. Further, the high R alloys can contain B.

After preparing the low R alloys and the high R alloys, these master alloys are crushed separately or together. The crushing step comprises a crushing process and a pulverizing process. First, each of the master alloys is crushed to a particle size of approximately several hundreds of μm. The crushing is preferably carried out in an inert gas atmosphere, using a stamp mill, a jaw crusher, a brown mill, etc. In order to improve rough crushability, it is effective to carry out crushing after the absorption of hydrogen. Otherwise, it is also possible to release hydrogen after absorbing it and then carry out crushing.

After carrying out the crushing, the routine proceeds to a pulverizing process. In the pulverizing process, a jet mill is mainly used, and crushed powders with a particle size of approximately several hundreds of μm are pulverized to a mean particle size between 3 and 5 μm. The jet mill is a method comprising releasing a high-pressure inert gas (e.g., nitrogen gas) from a narrow nozzle so as to generate a high-speed gas flow, accelerating the crushed powders with the high-speed gas flow, and making crushed powders hit against each other, the target, or the wall of the container, so as to pulverize the powders.

When the low R alloys and the high R alloys are pulverized separately in the pulverizing process, the pulverized low R alloy powders are mixed with the pulverized high R alloy powders in a nitrogen atmosphere. The mixing ratio of the low R alloy powders and the high R alloy powders may be approximately between 80:20 and 97:3 at a weight ratio. Likely, in a case where the low R alloys are pulverized together with the high R alloys, the mixing ratio may be approximately between 80:20 and 97:3 at a weight ratio. When approximately 0.01% to 0.3% by weight of additive agents such as zinc stearate is added during the pulverizing process, fine powders which are well oriented, can be obtained during compacting.

Subsequently, mixed powders comprising of the low R alloy powders and the high R alloy powders are filled in a tooling equipped with electromagnets, and they are compacted in a magnet field, in a state where their crystallographic axis is oriented by applying a magnetic field. This compacting may be carried out by applying a pressure of approximately 0.7 to 1.5 t/cm$^2$ in a magnetic field of 12.0 to 17.0 kOe.

After the mixed powders are compacted in the magnetic field, the compacted body is sintered in a vacuum or an inert gas atmosphere. The sintering temperature needs to be adjusted depending on various conditions such as a composition, a crushing method, the difference between particle size and particle size distribution, but the sintering may be carried out at 1,000° C. to 1,100° C. for about 1 to 5 hours. In the present invention, the Zr rich product is generated in the $R_2T_{14}B$ phase in this sintering process. The mechanism of generating after sintering the Zr rich product that did not exist in the low R alloy stage is unknown, but there is a possibility that Zr dissolved in the $R_2T_{14}B$ phase in the low R alloy stage might be deposited therein during the sintering process.

After completion of the sintering, the obtained sintered body may be subjected to an aging treatment. The aging treatment is important for the control of a coercive force. When the aging treatment is carried out in two steps, it is effective to retain the sintered body for a certain time at around 800° C. and around 600° C. When a heat treatment is carried out at around 800° C. after completion of the sintering, the coercive force increases. Accordingly, it is particularly effective in the mixing method. Moreover, when a heat treatment is carried out at around 600° C., the coercive force significantly increases. Accordingly, when the aging treatment is carried out in a single step, it is appropriate to carry out it at around 600° C.

EMBODIMENT EXAMPLES

Embodiment Example 1

An R-T-B system rare earth permanent magnet was manufactured by the following manufacturing process.

(1) Mother Alloys

Mother alloys (strips) having compositions and thicknesses shown in FIG. 1 were prepared by the strip casting method. The roll peripheral velocity of low R alloys was set to 1.5 m/s, and that of high R alloys was set to 0.6 m/s. The thickness of alloys was a mean value obtained by measuring the thicknesses of 50 strips. However, the roll peripheral velocity of the low R alloys in Comparative Example 3 shown in FIG. 1 was set to 0.6 m/s. It was confirmed that a Zr rich product (hereinafter referred to as an intraphase product) was not observed in the $R_2T_{14}B$ phase of the low R alloys of Example 1 as shown in FIG. 1, but that the intraphase product existed in the $R_2T_{14}B$ phase of the low R alloys of Comparative Example 3 as shown in the same figure.

(2) Hydrogen Crushing Process

A hydrogen crushing treatment was carried out, in which after hydrogen was absorbed at room temperature, dehydrogenation was carried out thereon at 600° C. for 1 hour in an Ar atmosphere.

To control the amount of oxygen contained in a sintered body to 2,000 ppm or less, so as to obtain high magnetic properties, in the present experiments, the atmosphere was controlled at an oxygen concentration less than 100 ppm throughout processes, from a hydrogen treatment (recovery after a crushing process) to sintering (input into a sintering furnace).

(3) Mixing and Crushing Processes

Generally, two-step crushing is carried out, which includes crushing process and pulverizing process. However, the crushing process was omitted in the present Examples.

Additive agents are mixed to the mother alloys before carrying out the pulverizing process. The types of additive agents are not particularly limited, and those contributing to the improvement of crushability and the improvement of orientation during compacting may be appropriately added. In the present Embodiment Example, 0.05% by weight of zinc stearate was added. Thereafter, using a Nauta Mixer, the low R alloys were mixed with the high R alloys for 30 minutes in the combination of each of Example 1 and Comparative Examples 1 to 3 as shown in FIG. 1. In all of Example 1 and Comparative Examples 1 to 3, the mixing ratio between the low R alloys and the high R alloys was 90:10.

Thereafter, the mixture was subjected to the pulverizing with a jet mill to a mean particle size of 4.8 to 5.1 μm.

(4) Compacting Process

The obtained fine powders were compacted in a magnetic field of 15.0 kOe by applying a pressure of 1.2 t/cm$^2$, so as to obtain a compacted body.

(5) Sintering and Aging Processes

The obtained compacted body was sintered at 1,070° C. for 4 hours in a vacuum atmosphere, followed by quenching. Thereafter, the obtained sintered body was subjected to a two-step aging treatment consisting of treatments of 800° C.×1 hour and 550° C.×2.5 hours (both in an Ar atmosphere).

The magnetic properties of the obtained permanent magnets were measured with a B-H tracer. The results are shown in FIGS. 2 to 5. In FIGS. 2 to 5, Br represents a residual magnetic flux density, HcJ represents a coercive force, and "Hk/HcJ" means a squareness. The squareness (Hk/HcJ) is an index of magnet performance, and it represents an angular degree in the second quadrant of a magnetic hysteresis loop. Furthermore, Hk means an external magnetic field strength obtained when the magnetic flux density becomes 90% of the residual magnetic flux density in the second quadrant of a magnetic hysteresis loop. In FIGS. 2 to 5, a permanent magnet in which an intraphase product was observed is marked with a circle (○), and a permanent magnet in which the product was not observed is marked with a cross (X). The presence or absence of an intraphase product was confirmed based on observation with TEM (Transmission Electron Microscope, JEM-3010 manufactured by Japan Electron Optics Laboratory Co., Ltd). The sample for the observation was obtained by the ion-milling method, and the C plane of the $R_2T_{14}B$ phase was observed. It is noted that the chemical compositions of the obtained sintered body are shown in the column "Composition of sintered body" in FIG. 1. Further, no intraphase products were observed in Comparative Example 3, but the Zr rich product was observed in a grain boundary phase thereof.

Figure 5:
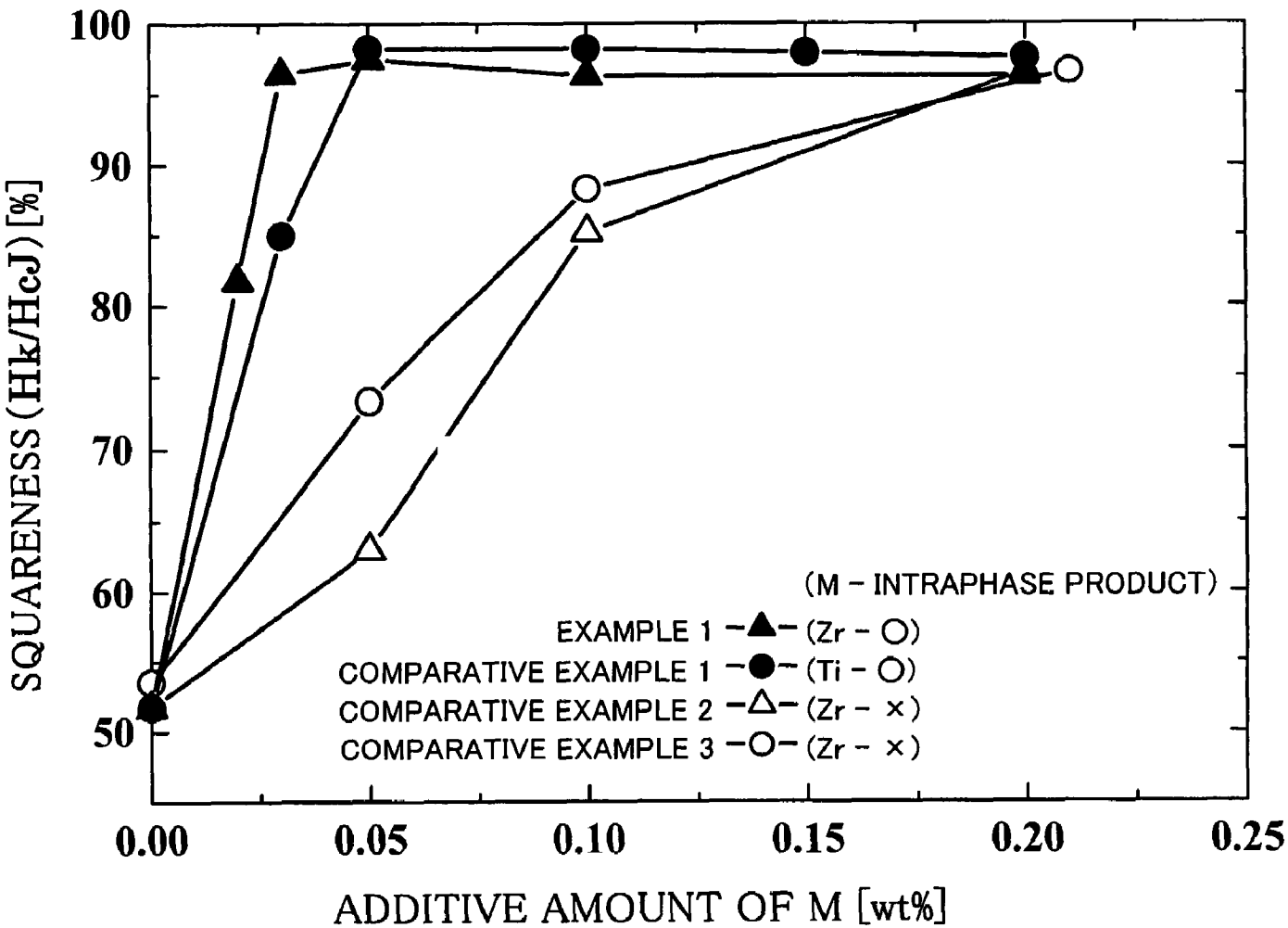
FIG. 5 is a graph showing the relationship between the amount of additive element M (Zr or Ti) and the squareness (Hk/HcJ) of each of the permanent magnets obtained in Embodiment Example 1.

From FIGS. 2 and 5, it is found that in R-T-B system rare earth permanent magnets in which an intraphase product was observed (Example 1 and Comparative Example 1), the abnormal grain growth was inhibited and the squareness (Hk/HcJ) was improved by adding only a small amount of additive element M (Zr or Ti). However, in a case where Ti was selected as an additive element M as shown in FIG. 3, the residual magnetic flux density (Br) was significantly decreased. Moreover, even in the case of R-T-B system rare earth permanent magnets in which no intraphase products were observed (Comparative Examples 2 and 3), the squareness (Hk/HcJ) was improved by adding as a large amount of Zr as 0.2% by weight (refer to FIG. 5). However, a decrease in the residual magnetic flux density (Br) was still significant (refer to FIG. 3). As described above, an R-T-B system rare earth permanent magnet in which the presence of an intraphase product is observed enables to obtain a high squareness (Hk/HcJ), while inhibiting a decrease in the residual magnetic flux density (Br).

With regard to Comparative Example 3 in which an intraphase product was observed in the $R_2T_{14}B$ phase in the stage of low R alloys, the reason why no intraphase products exist in the R-T-B system rare earth permanent magnet is assumed as follows. A Zr rich product generated in the $R_2T_{14}B$ phase (intraphase product) in the stage of low R alloys has been grown to be extremely large. It is assumed that although this product is subjected to the hydrogen crushing process, it does not lead to volume expansion. It is therefore understood that a crack is generated on the interface between the $R_2T_{14}B$ phase and the product during the hydrogen crushing process. When the alloys are subjected to a crushing process in this state, the product is separated from the $R_2T_{14}B$ phase. As a result, the product is not contained in the $R_2T_{14}B$ phase, but it exists independently from the $R_2T_{14}B$ phase. Accordingly, it is considered that in the R-T-B system rare earth permanent magnet of Comparative Example 3, the Zr rich product exists only in the grain boundary phase even after the sintering process.

Figure 6:
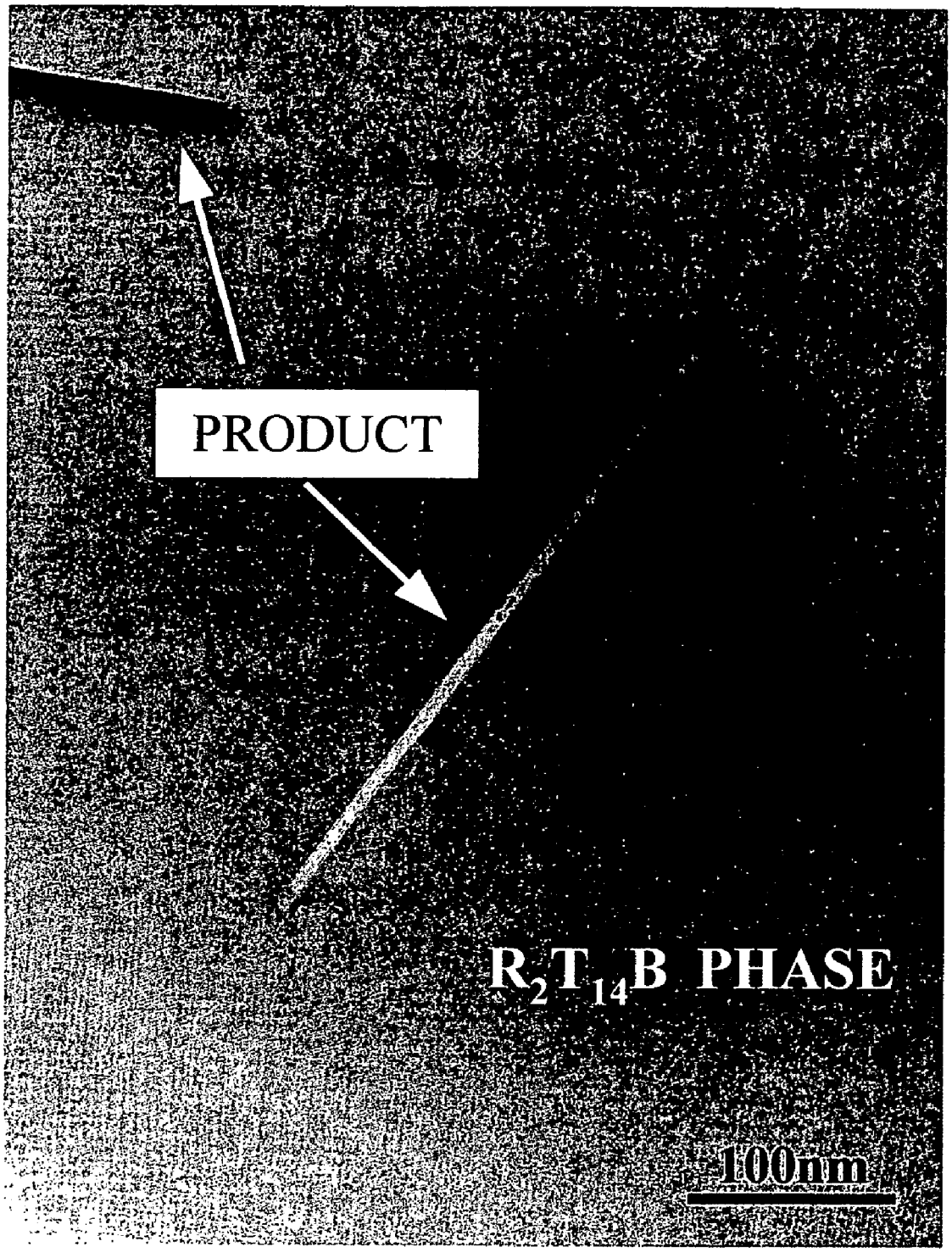
FIG. 6 is a TEM (Transmission Electron Microscope) photograph of a sample (containing 0.10% by weight of Zr) of Example 1.
Figure 7A:
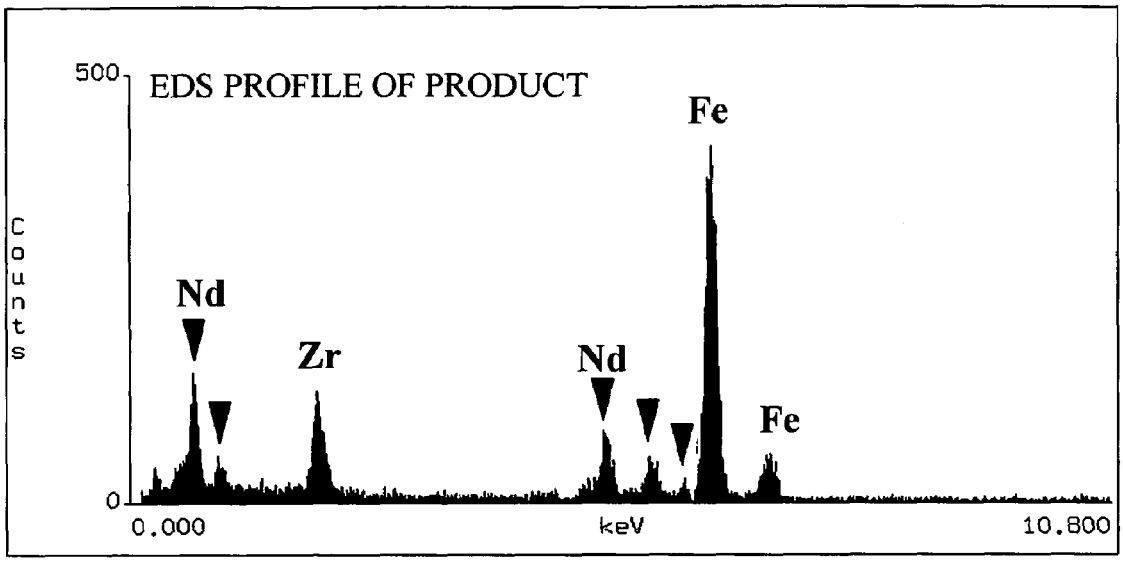
FIG. 7A is a diagram showing an EDS (Energy Dispersive X-ray Fluorescence Spectrometer) profile of a product existing in the sample (containing 0.10% by weight of Zr) of Example 1.
Figure 7B:
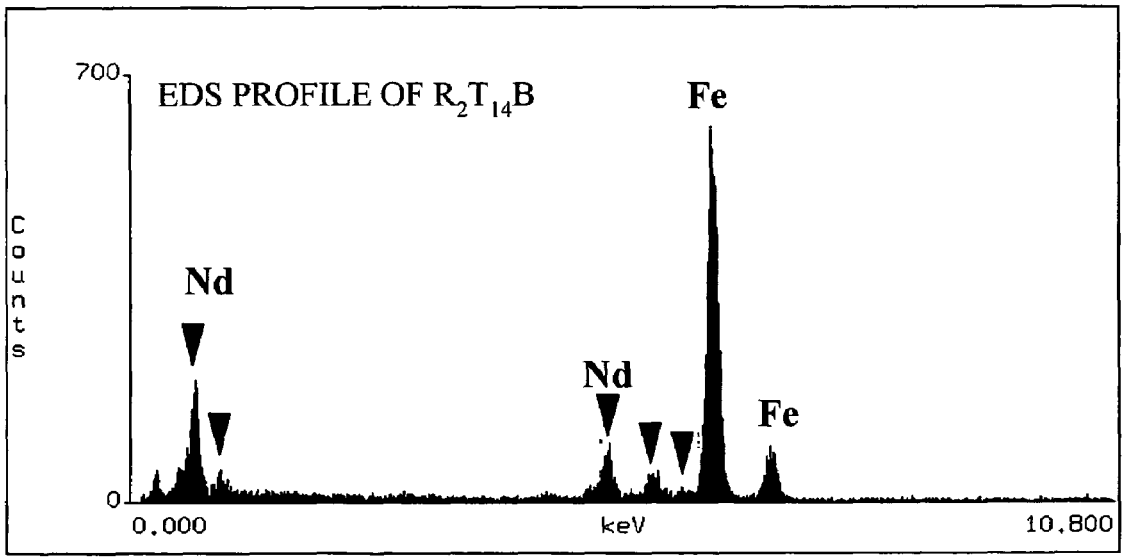
FIG. 7B is a diagram showing an EDS profile of the $R_2T_{14}B$ phase of the sample (containing 0.10% by weight of Zr) of Example 1.
Figure 8:
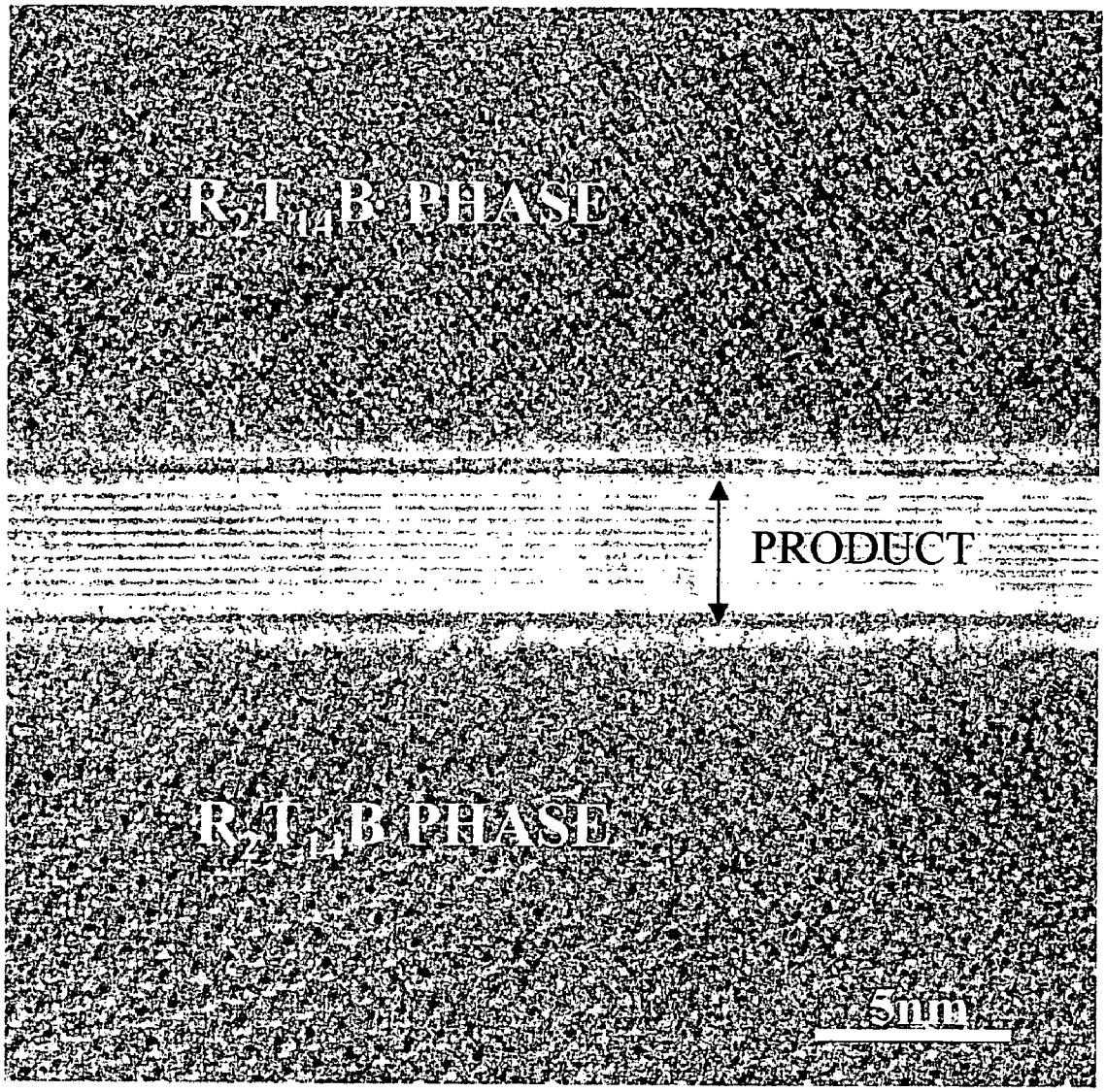
FIG. 8 is a high resolution TEM photograph of the sample (containing 0.10% by weight of Zr) of Example 1.

An R-T-B system rare earth permanent magnet containing 0.10% by weight of Zr in Example 1 was observed by TEM in the same manner as described above. The observation results are shown in FIGS. 6 to 8. FIG. 6 is a TEM photograph of a sample containing 0.10% by weight of Zr. FIG. 7 is a set of EDS (Energy Dispersive X-ray Fluorescence Spectrometer) profiles of a product existing in the sample and the $R_2T_{14}B$ phase of the sample. FIG. 8 is a high resolution TEM photograph of the sample.

Figure 9:
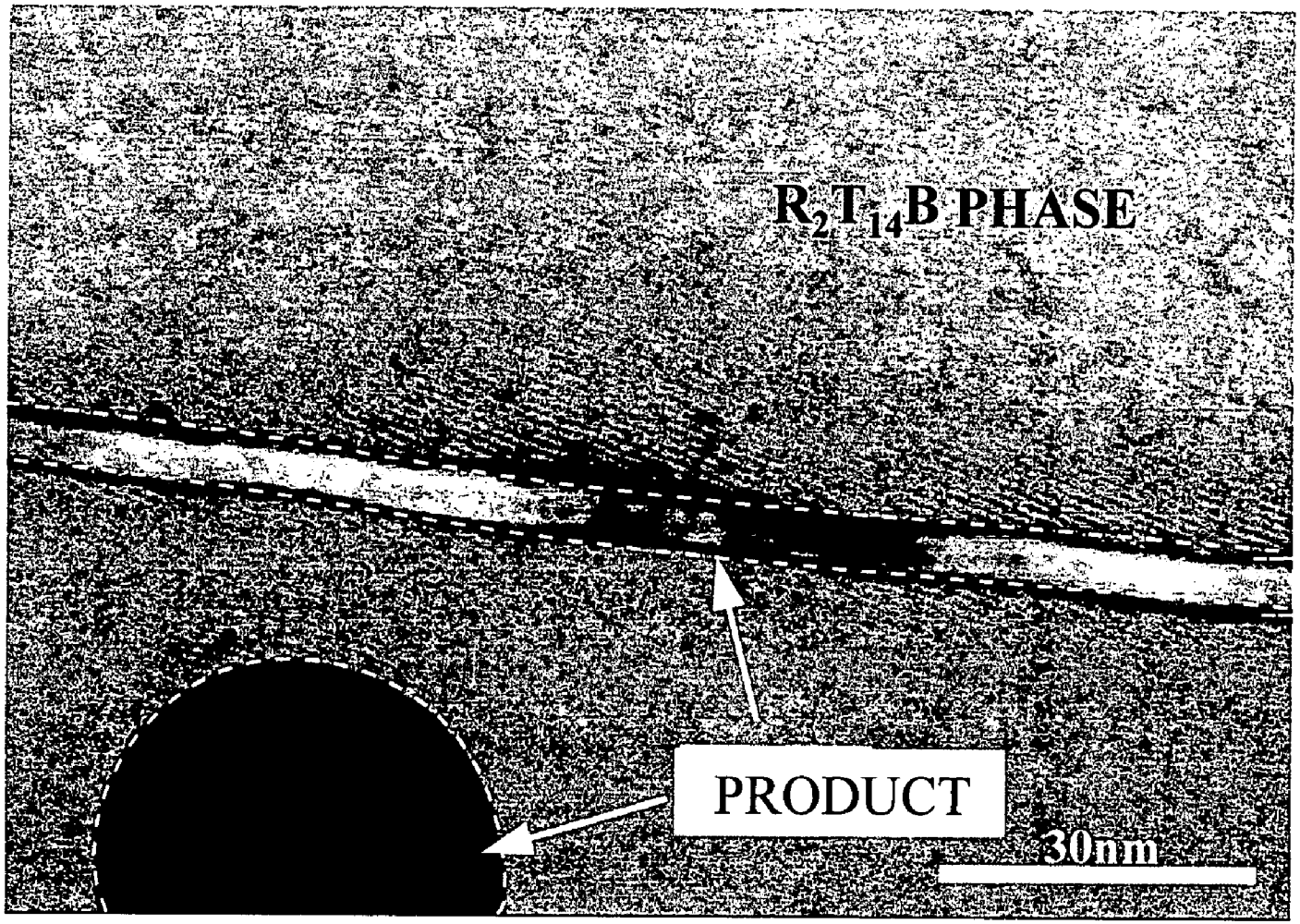
FIG. 9 is a TEM photograph of the sample (containing 0.10% by weight of Zr) of Example 1.
Figure 10:
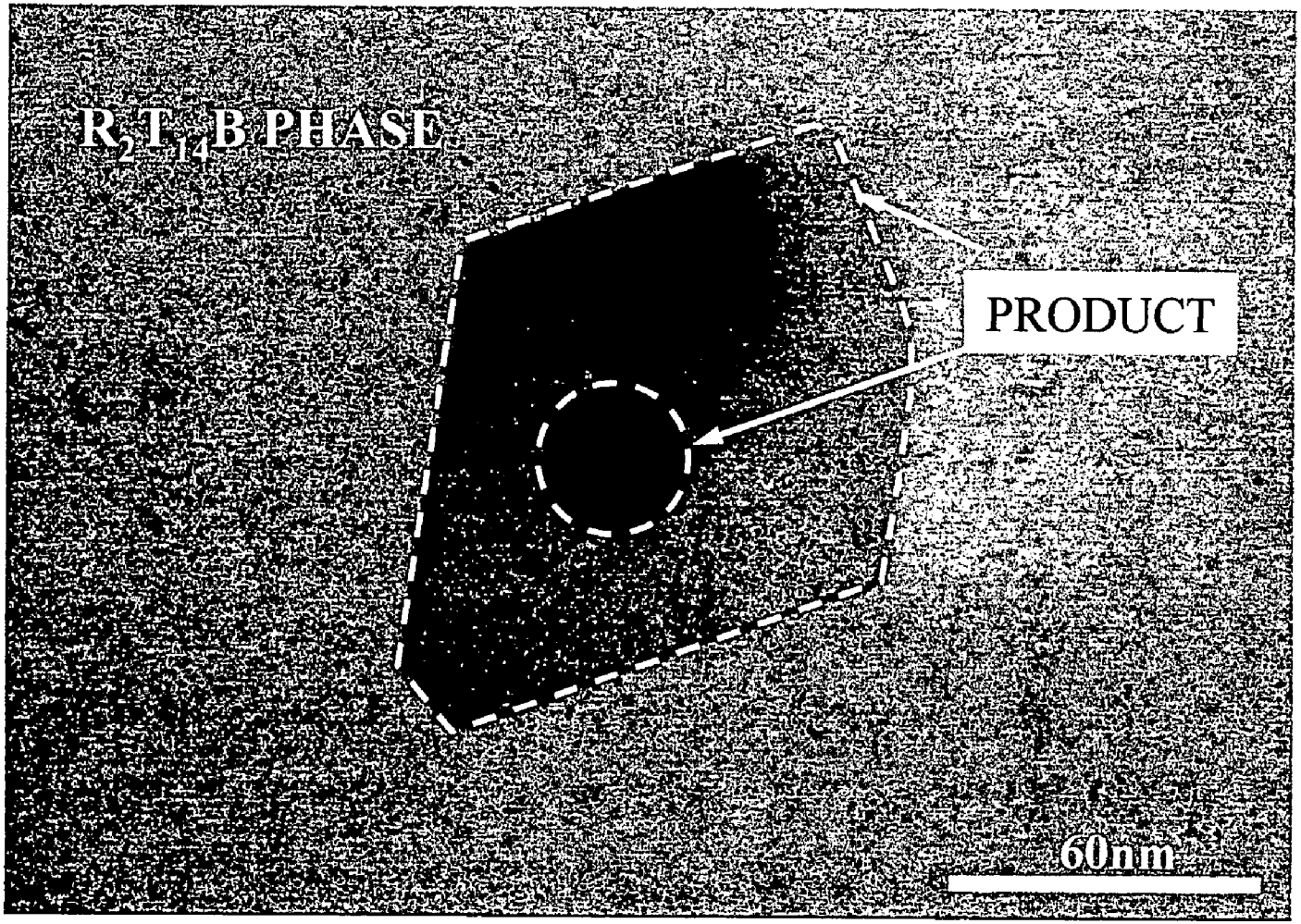
FIG. 10 is another TEM photograph of the sample (containing 0.10% by weight of Zr) of Example 1.

As shown in FIG. 6, an intraphase product with a large axis ratio can be observed in the $R_2T_{14}B$ phase. This product has a platy or acicular form. FIG. 6 is a photograph obtained by observing the cross section of the sample, and it is therefore difficult to determine from such observation whether the form is platy or acicular. Considering the results from the observation of other samples and FIG. 8, the intraphase product has a length of several hundreds nm and a width between several nm and 15 nm. The detailed chemical composition of this intraphase product is uncertain, but from FIG. 7A, it can be confirmed that the intraphase product is at least rich in Zr. Moreover, as a result of observation of other samples, other than the intraphase product with a large axis ratio, indefinite or round shape intraphase products can also be observed, as shown in FIGS. 9 and 10. As a result of observing 20 crystal grains ($R_2T_{14}B$ phase) of Example 1, intraphase products were observed in 6 crystal grains thereof. In contrast, in Comparative Example 2, no intraphase products were observed in any of 20 crystal grains ($R_2T_{14}B$ phase).

Figure 11A:
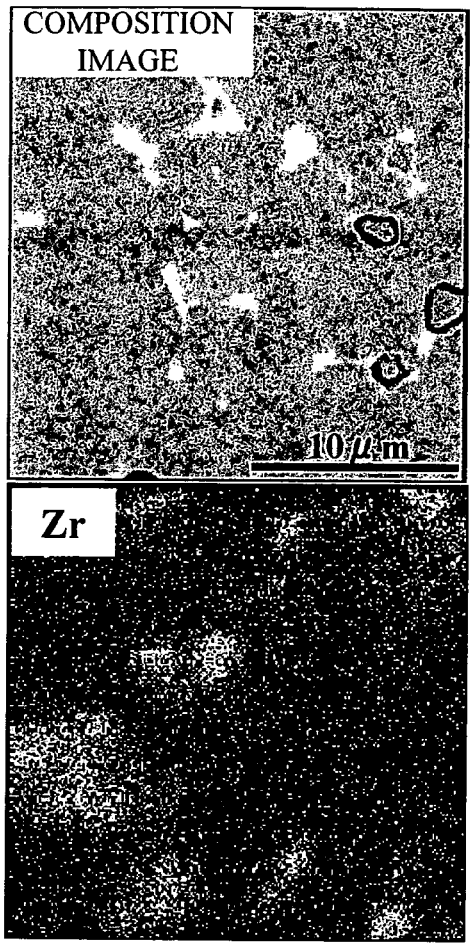
FIG. 11A is a photograph (lower) showing the Zr mapping results of the sample (containing 0.10% by weight of Zr) of Example 1 by EPMA (Electron Probe Micro Analyzer), and a photograph (upper) showing a composition image in the same scope as the Zr mapping results (lower)
Figure 11B:
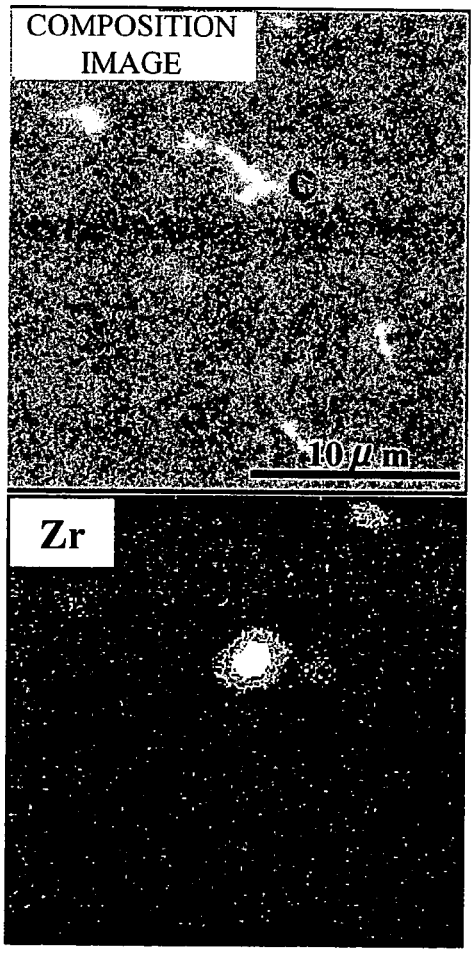
FIG. 11B is a photograph (lower) showing the Zr mapping results of a sample (containing 0.10% by weight of Zr) of Comparative Example 2 by EPMA, and a photograph (upper) showing a composition image in the same scope as the Zr mapping results (lower)

The lower image of FIG. 11A shows the Zr mapping results of a sample containing 0.10% by weight of Zr of Example 1 by EPMA (Electron Probe Micro Analyzer). The upper image of FIG. 11A shows a composition image in the same scope as the Zr mapping results shown in the lower image of FIG. 11A. Moreover, the lower image of FIG. 11B shows the Zr mapping results of a sample containing 0.10% by weight of Zr of Comparative Example 2 by EPMA. The upper image of FIG. 11B shows a composition image in the same scope as the Zr mapping results shown in the lower image of FIG. 11B.

As with the results obtained by the observation by TEM, it is found from FIG. 11A that an $R_2T_{14}B$ phase that is rich in Zr is present in the permanent magnet of Example 1, and that Zr exists also in a grain boundary phase thereof. In contrast, it is found from FIG. 11B that such a Zr rich $R_2T_{14}B$ phase is not observed in the permanent magnet of Comparative Example 2, and that Zr exists only in a grain boundary phase thereof.

Embodiment Example 2

Figure 13:
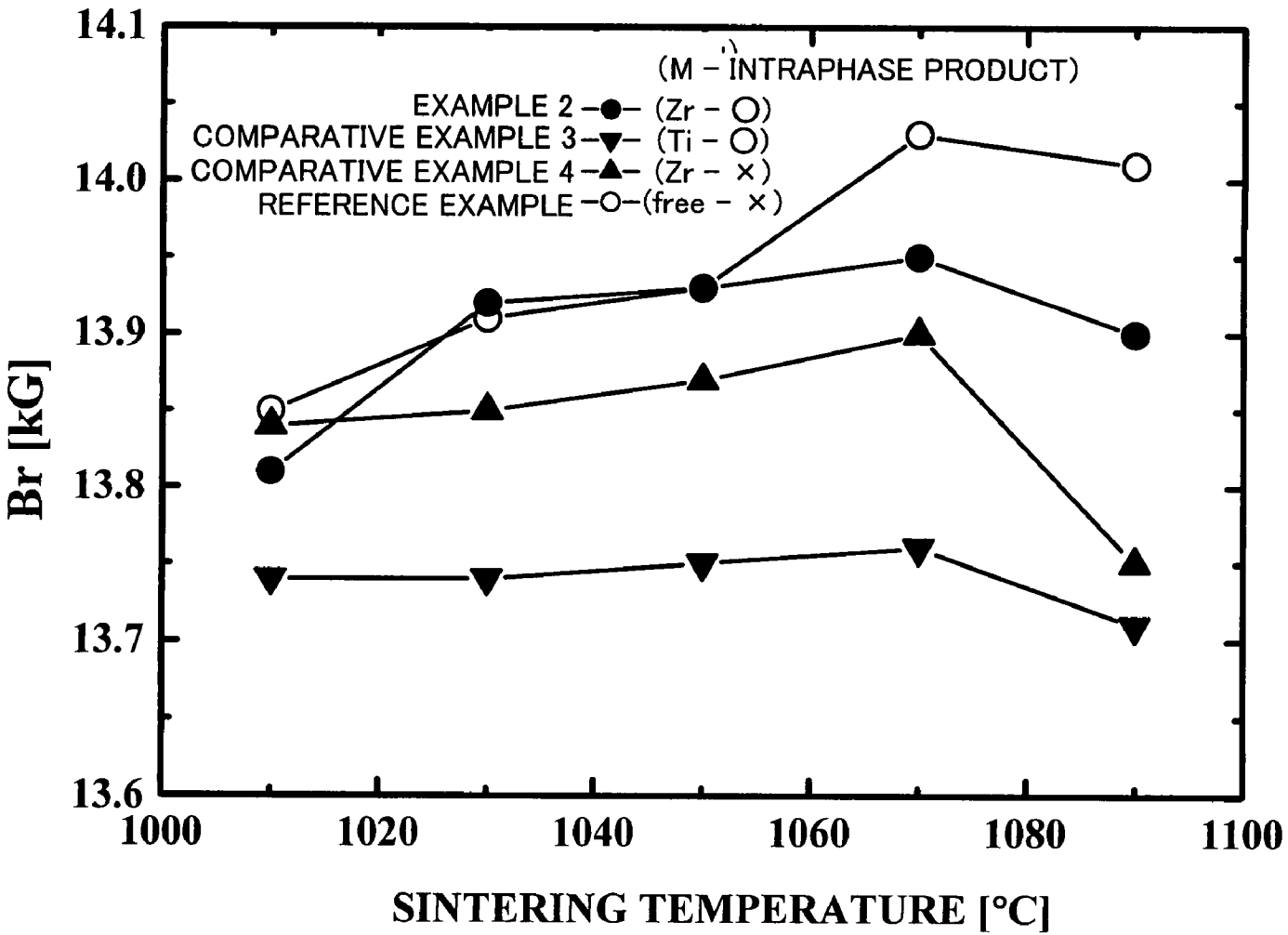
FIG. 13 is a graph showing the relationship between the sintering temperature and the residual magnetic flux density (Br) in Embodiment Example 2.
Figure 14:
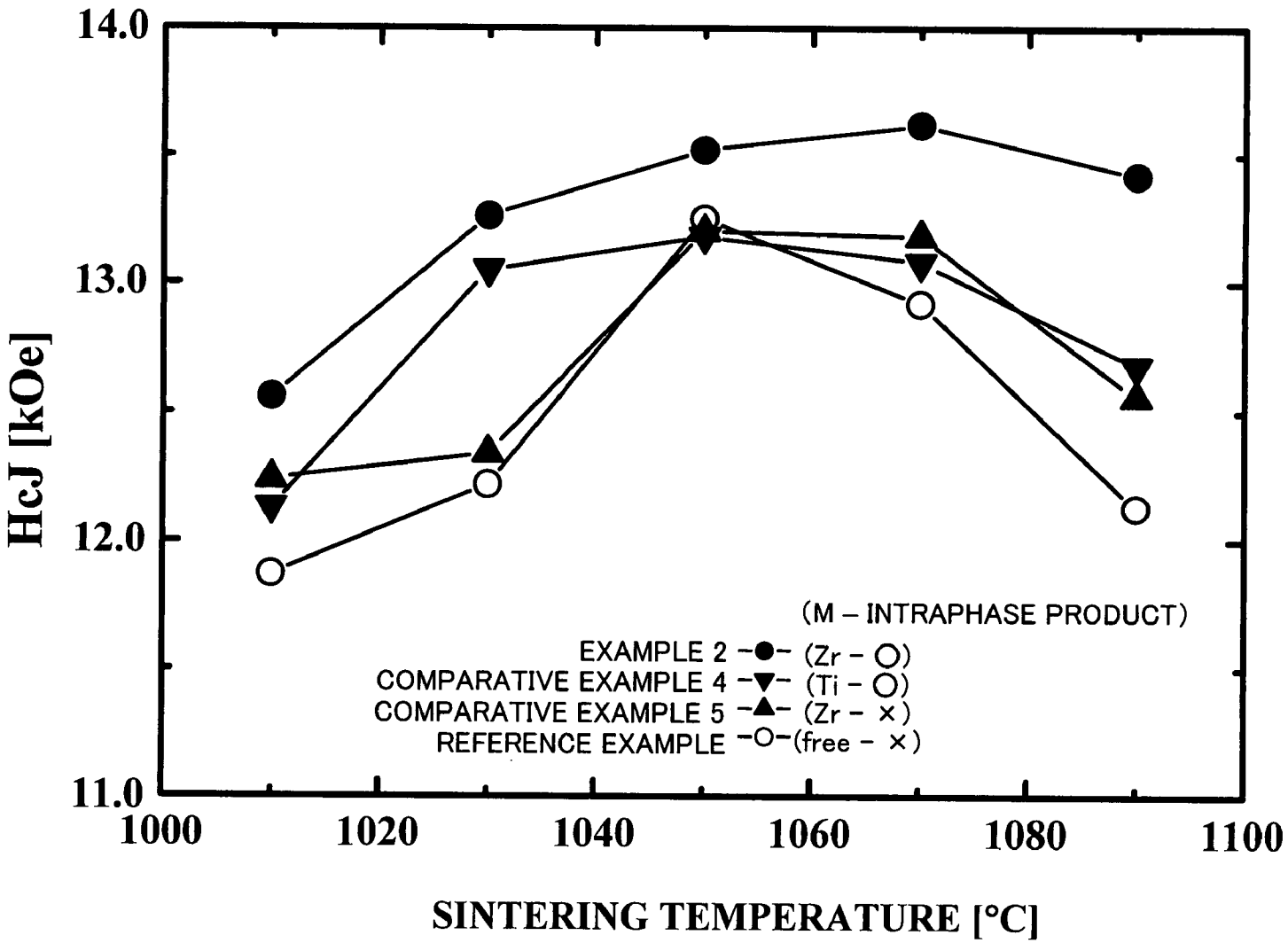
FIG. 14 is a graph showing the relationship between the sintering temperature and the coercive force (HcJ) in Embodiment Example 2.
Figure 15:
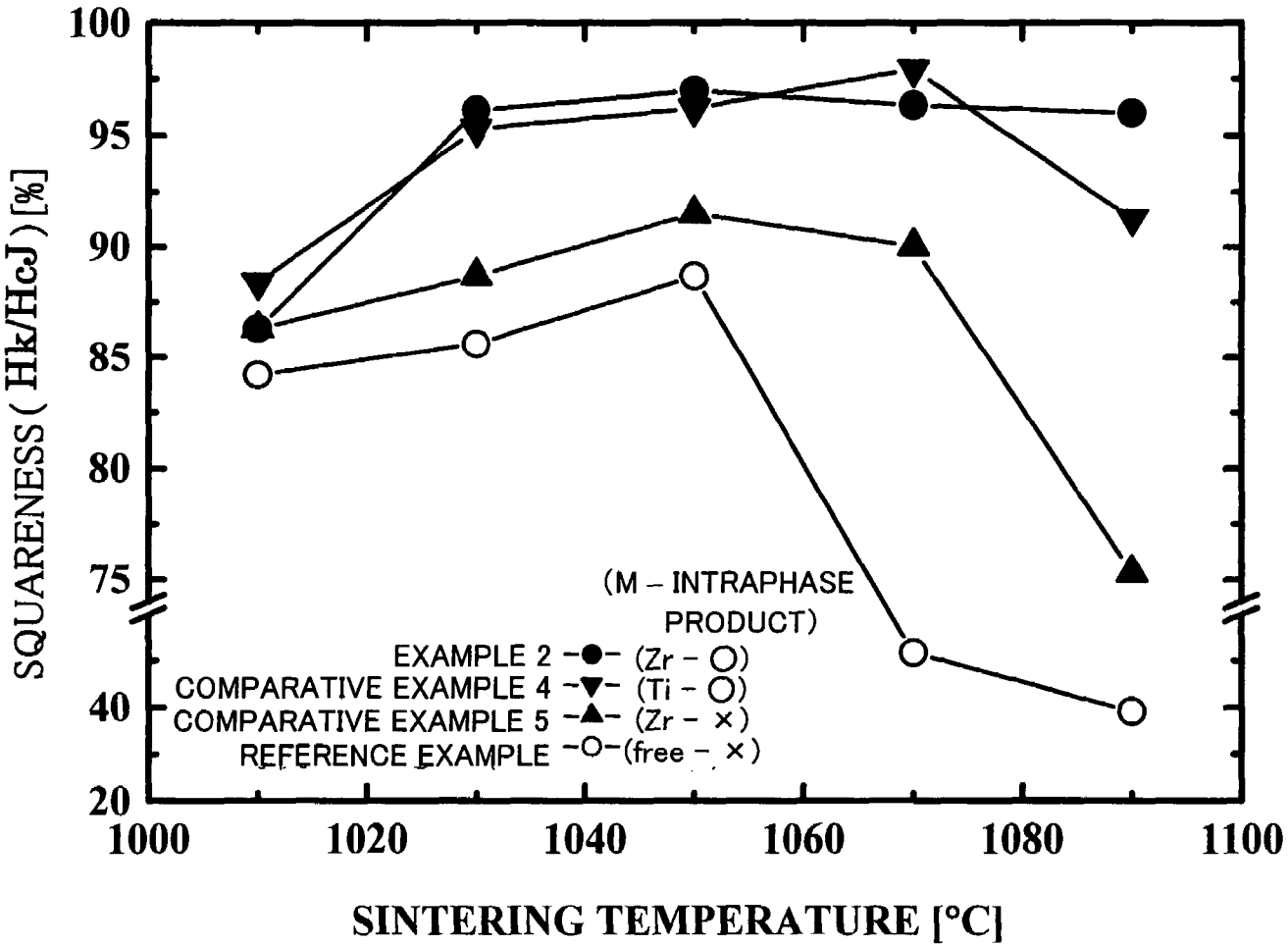
FIG. 15 is a graph showing the relationship between the sintering temperature and the squareness (Hk/HcJ) in Embodiment Example 2.
Figure 16:
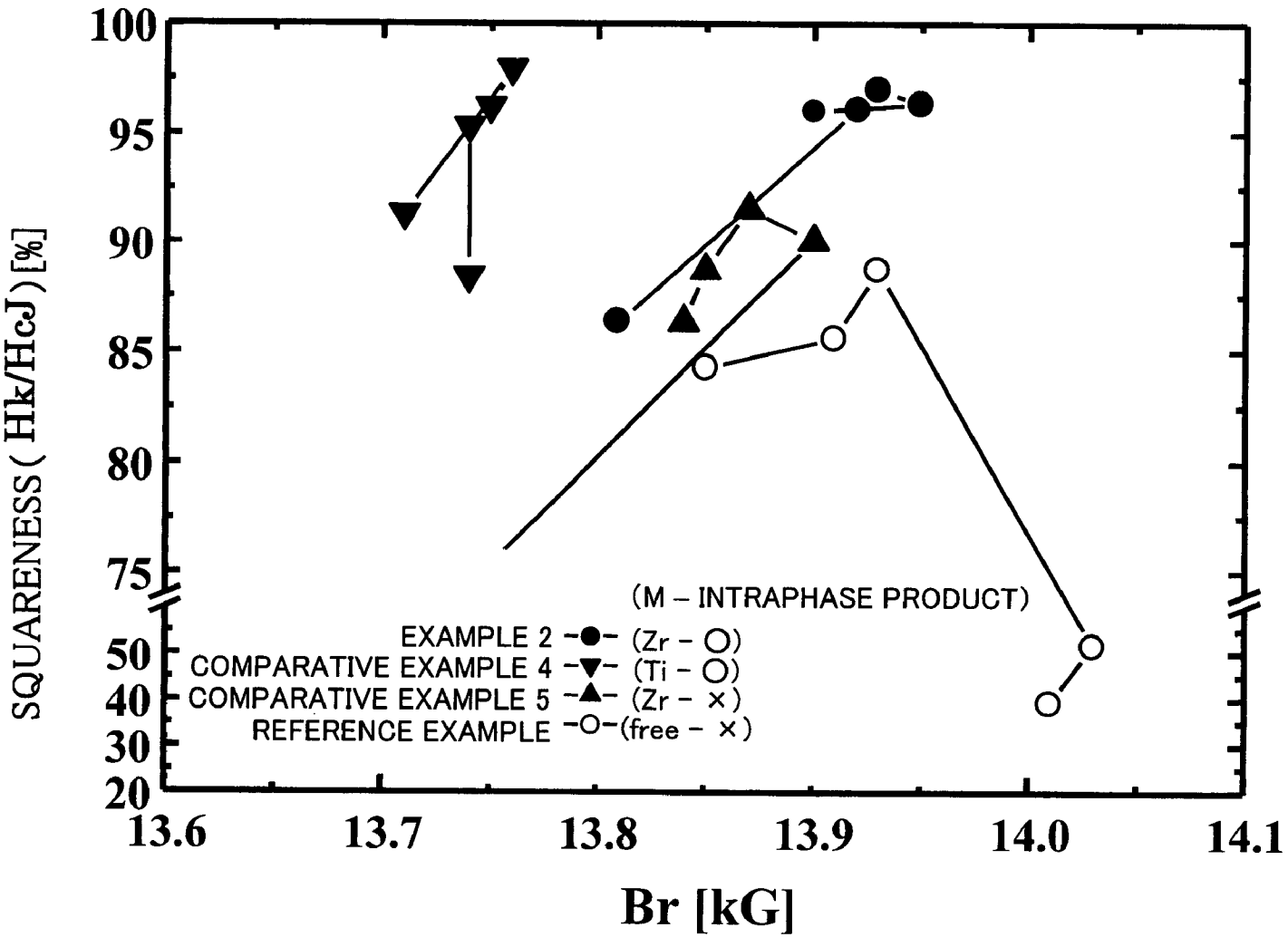
FIG. 16 is a graph showing the correspondence between the residual magnetic flux density (Br) and the squareness (Hk/HcJ) at each sintering temperature in Embodiment Example 2.

R-T-B system rare earth permanent magnets were obtained in the same manner as in Embodiment Example 1 with the exception that samples each containing 0.10% by weight of additive element M (Zr or Ti) of the composition of the sintered body were sintered for 4 hours within the temperature range between 1,010° C. and 1,090° C. The magnetic properties of the obtained permanent magnets were measured in the same manner as in Embodiment Example 1. The results are shown in FIG. 12. In addition, changes in the magnetic properties by changes in the sintering temperature are shown in FIGS. 13 to 15. Moreover, the magnetic properties at each sintering temperature plotted as a squareness (Hk/HcJ) to a residual magnetic flux density (Br) are shown in FIG. 16.

As shown in FIGS. 12 to 16, it is found that when an intraphase product is obtained by adding Zr as an additive element M, high magnetic properties are stably obtained in a wide sintering temperature range. More specifically, in Example 2 of the present invention, a residual magnetic flux density (Br) of 13.9 kG or greater, a coercive force (HcJ) of 13.0 kOe or greater, and a squareness (Hk/HcJ) of 95% or more can be obtained in the sintering temperature range between 1,030° C. and 1,090° C. If Ti is added as an additive element M, the residual magnetic flux density (Br) decreases (Comparative Example 4). Moreover, when no intraphase products exist, the squareness (Hk/HcJ) is poor, and the suitable sintering temperature range is narrow (Comparative Example 5).

Embodiment Example 3

Setting a roll peripheral velocity to 0.6 to 1.8 m/s, 4 types of low R alloys and 2 types of high R alloys having the compositions and thicknesses as shown in FIG. 17 were prepared by the strip casting method. Thereafter, 4 types of R-T-B system rare earth permanent magnets with the combinations as shown in FIG. 17 were obtained. In all of samples A to D, the mixing ratio between the low R alloys and the high R alloys was 90:10. The low R alloys and the high R alloys as shown in FIG. 17 were subjected to hydrogen crushing in the same manner as in Embodiment Example 1. After completion of the hydrogen crushing process, 0.05% by weight of butyl oleate was added thereto. Thereafter, using a Nauta mixer, the low R alloys were mixed with the high R alloys for 30 minutes in the combinations as shown in FIG. 17. Thereafter, the mixture was subjected to the pulverizing with a jet mill to a mean particle size of 4.1 μm. The obtained fine powders were compacted in a magnetic field under the same conditions as in Embodiment Example 1, followed by sintering at 1,010° C. to 1,090° C. for 4 hours. Thereafter, the obtained sintered body was subjected to a two-step aging treatment consisting of treatments of 800° C.×1 hour and 550° C.×2.5 hours. The composition, the amount of oxygen, and the amount of nitrogen of each of the obtained sintered bodies are shown in FIG. 17. In addition, magnetic properties thereof are shown in FIG. 18.

As shown in FIG. 18, sample A has a residual magnetic flux density (Br) of 14.0 kG or greater, a coercive force (HcJ) of 13.0 kOe or greater, and a squareness (Hk/HcJ) of 95% or more in the sintering temperature range between 1,030° C. and 1,070° C.

Samples B and C, both of which contain a lower amount of Nd than sample A, have a residual magnetic flux density (Br) of 14.0 kG or greater, a coercive force (HcJ) of 13.5 kOe or greater, and a squareness (Hk/HcJ) of 95% or more in the sintering temperature range between 1,030° C. and 1,090° C.

Sample D containing a higher amount of Dy than sample A has a residual magnetic flux density (Br) of 13.5 kG or greater, a coercive force (HcJ) of 15.5 kOe or greater, and a squareness (Hk/HcJ) of 95% or more in the sintering temperature range between 1,030° C. and 1,070° C.

As a result of the observation of the samples sintered at 1,050° C. by TEM, intraphase products were observed in all the samples.

From the above results, it can be said that when an intraphase product exists, high magnetic properties can be consistently obtained in a wide suitable sintering temperature range of 40° C. or more.

Embodiment Example 4

2 types of low R alloys and 2 types of high R alloys were prepared by the strip casting method. Thereafter, 2 types of R-T-B system rare earth permanent magnets with the combinations as shown in FIG. 19 were obtained. In sample E, the mixing ratio between the low R alloys and the high R alloys was 90:10. On the other hand, in sample F, the mixing ratio between the low R alloys and the high R alloys was 80:20. The low R alloys and the high R alloys as shown in FIG. 19 were subjected to hydrogen crushing in the same manner as in Embodiment Example 1. After completion of the hydrogen crushing process, 0.05% by weight of butyl oleate was added thereto. Thereafter, using a Nauta mixer, the low R alloys were mixed with the high R alloys for 30 minutes in the combinations as shown in FIG. 19. Thereafter, the mixture was subjected to the pulverizing with a jet mill to a mean particle size of 4.0 μm. The obtained fine powders were compacted in a magnetic field under the same conditions as in Embodiment Example 1. Thereafter, in the case of sample E, the compacted body was sintered at 1,070°

C. for 4 hours, and in the case of sample F, it was sintered at 1,020° C. for 4 hours. Thereafter, the obtained sintered bodies of both samples E and F were subjected to a two-step aging treatment consisting of treatments of 800° C.×1 hour and 550° C.×2.5 hours. The composition, the amount of oxygen, and the amount of nitrogen of each of the obtained sintered bodies are shown in FIG. 19. In addition, magnetic properties thereof are shown in FIG. 20. For convenience of comparison, the magnetic properties of samples A to D prepared in Embodiment Example 3 are also shown in FIG. 20.

Although the constitutional elements were fluctuated as shown in samples A to F, a residual magnetic flux density (Br) of 13.8 kG or greater, a coercive force (HcJ) of 13.0 kOe or greater, and a squareness (Hk/HcJ) of 95% or more were obtained.

INDUSTRIAL APPLICABILITY

As described in detail above, in a sintering process, a Zr rich product is allowed to exist in an $R_2T_{14}B$ phase, so that the grain growth can be inhibited, while keeping a decrease in magnetic properties to a minimum. Moreover, according to the present invention, since a suitable sintering temperature range of 40° C. or more can be kept, even using a large sintering furnace that is usually likely to cause unevenness in heating temperature, an R-T-B system rare earth permanent magnet consistently having high magnetic properties can be easily obtained.

What is claimed is:

1. A method for manufacturing an R-T-B system rare earth permanent magnet comprising a sintered body having 0.03% to 0.25% by weight of Zr, wherein said sintered body comprises a main phase consisting of an $R_2T_{14}B$ phase (wherein R represents one or more rare earth elements, providing that the rare earth elements include Y), and T represents one or more transition metal elements essentially containing Fe, or Fe and Co, and a grain boundary phase containing a higher amount of R than said main phase, wherein a product that is rich in Zr exists in said $R_2T_{14}B$ phase, said manufacturing method comprising the steps of:

preparing an R-T-B alloy containing as a main component said $R_2T_{14}B$ phase and also containing the whole amount of Zr, and an R-T alloy containing R and T as main components, wherein the amount of R is higher than that of said R-T-B alloy;

obtaining a mixture of a powder of said R-T-B alloy and a powder of said R-T alloy;

preparing a compacted body with a certain form from said mixture; and sintering said compacted body, wherein, in said sintering step, said product is generated in said $R_2T_{14}B$ phase; and wherein said R-T-B alloy is prepared by the strip casting method under the condition that the peripheral velocity of a chill roll is 1.0 to 1.8 m/s.

2. A method for manufacturing an R-T-B system rare earth permanent magnet according to claim 1, wherein said product is platy or acicular.

3. A method for manufacturing an R-T-B system rare earth permanent magnet according to claim 1, wherein said R-T-B alloy that does not contain said product is prepared, and then the steps up to said sintering step of sintering said compacted body are carried out, while avoiding the generation of said product.

4. A method for manufacturing an R-T-B system rare earth permanent magnet according to claim 1, wherein the amount of oxygen contained in said sintered body is 2,000 ppm or less.

* * * * *